US007788824B2

(12) United States Patent
Hann

(10) Patent No.: US 7,788,824 B2
(45) Date of Patent: Sep. 7, 2010

(54) SHOE APPARATUS WITH IMPROVED EFFICIENCY

(75) Inventor: Lenn R. Hann, Wheaton, IL (US)

(73) Assignee: Energy Management Athletics, LLC, Wheaton, IL (US)

( * ) Notice: Subject to any disclaimer, the term of this patent is extended or adjusted under 35 U.S.C. 154(b) by 881 days.

(21) Appl. No.: 11/570,214

(22) PCT Filed: Jun. 7, 2005

(86) PCT No.: PCT/US2005/019915

§ 371 (c)(1),
(2), (4) Date: Dec. 7, 2006

(87) PCT Pub. No.: WO2005/120272

PCT Pub. Date: Dec. 22, 2005

(65) Prior Publication Data

US 2007/0175066 A1 Aug. 2, 2007

Related U.S. Application Data

(63) Continuation-in-part of application No. 10/862,638, filed on Jun. 7, 2004, now Pat. No. 7,334,351.

(51) Int. Cl.
*A43B 13/28* (2006.01)

(52) U.S. Cl. ..... 36/27; 36/28; 36/102; 36/37

(58) Field of Classification Search ..... 36/27–29, 36/102, 25 R, 37, 35 R, 38
See application file for complete search history.

(56) References Cited

U.S. PATENT DOCUMENTS

| | | | |
|---|---|---|---|
| 759,000 | A | 3/1868 | Hale et al. |
| 224,937 | A | 2/1880 | Mintzer |
| 291,490 | A | 1/1884 | Buch |
| 324,065 | A | 8/1885 | Andrews |
| 357,062 | A | 2/1887 | Buch |
| 413,693 | A | 10/1889 | Walker |
| 427,136 | A | 5/1890 | Walker |
| 766,101 | A | 7/1904 | Croner |
| 871,864 | A | 11/1907 | Feazell et al. |
| 1,088,328 | A | 2/1914 | Cucinotta |
| 1,352,865 | A | 9/1920 | Augestad |
| 1,469,920 | A | 10/1923 | Dutchak |
| 1,471,966 | A | 10/1923 | Light |
| 1,587,749 | A | 6/1926 | Bierly |
| 1,625,048 | A | 4/1927 | Nock |
| 1,638,350 | A | 8/1927 | Long |
| 1,726,028 | A | 8/1929 | Keller |

(Continued)

OTHER PUBLICATIONS

PCT International Search Report for International Application No. PCT/US2005/019915; Internaitonal Filing Date Jun. 7, 2005; Priority Date; Jun. 7, 2004.

(Continued)

*Primary Examiner*—Marie Patterson
(74) *Attorney, Agent, or Firm*—Oblon, Spivak, McClelland, Maier & Neustadt, L.L.P.

(57) ABSTRACT

A shoe for improving use efficiency through reduction of neuromuscular fatigue. The shoe comprising a midsole with a suspension element and a hinge.

30 Claims, 19 Drawing Sheets

U.S. PATENT DOCUMENTS

| | | | | |
|---|---|---|---|---|
| 1,929,126 | A | 10/1933 | Tukl et al. | |
| 1,942,312 | A | 1/1934 | Tutoky | |
| 2,172,000 | A | 9/1939 | Wenker | |
| 2,399,543 | A | 4/1946 | Dack | |
| 2,413,545 | A | 12/1946 | Cordi | |
| 2,447,603 | A | 8/1948 | Snyder | |
| 2,814,132 | A | 11/1957 | Montoscuro | |
| 2,953,861 | A | 9/1960 | Horten | |
| 3,886,674 | A | 6/1975 | Pavia | |
| 4,241,523 | A | 12/1980 | Daswick | |
| 4,309,832 | A | 1/1982 | Hunt | |
| 4,342,158 | A | 8/1982 | McMahon et al. | |
| 4,457,084 | A | 7/1984 | Horibata et al. | |
| 4,492,046 | A | 1/1985 | Kosova | |
| 4,492,374 | A | 1/1985 | Lekhtman et al. | |
| 4,534,124 | A | 8/1985 | Schnell | |
| 4,566,206 | A | 1/1986 | Weber | |
| 4,592,153 | A | 6/1986 | Jacinto | |
| 4,638,575 | A | 1/1987 | Illustrato | |
| 4,843,737 | A | 7/1989 | Vorderer | |
| 4,881,329 | A | 11/1989 | Crowley | |
| 4,910,884 | A | 3/1990 | Lindh et al. | |
| 5,005,300 | A | 4/1991 | Diaz et al. | |
| 5,060,401 | A | 10/1991 | Whatley | |
| 5,138,776 | A | 8/1992 | Levin | |
| 5,279,051 | A | 1/1994 | Whatley | |
| 5,282,325 | A | 2/1994 | Beyl | |
| 5,343,636 | A | 9/1994 | Sabol | |
| 5,353,523 | A | 10/1994 | Kilgore et al. | |
| 5,367,790 | A | 11/1994 | Gamow et al. | |
| 5,381,608 | A | 1/1995 | Claveria | |
| 5,396,718 | A | 3/1995 | Schuler et al. | |
| 5,435,079 | A | 7/1995 | Gallegos | |
| 5,461,800 | A | 10/1995 | Luthi et al. | |
| 5,477,626 | A | 12/1995 | Kwon | |
| 5,513,448 | A | 5/1996 | Lyons | |
| 5,577,334 | A | 11/1996 | Park | |
| 5,706,589 | A | 1/1998 | Marc | |
| 5,729,916 | A | 3/1998 | Vorobiev et al. | |
| 5,771,606 | A * | 6/1998 | Litchfield et al. | 36/29 |
| 5,784,808 | A | 7/1998 | Hockerson | |
| 5,822,886 | A | 10/1998 | Luthi et al. | |
| 5,875,567 | A | 3/1999 | Bayley | |
| 5,896,679 | A | 4/1999 | Baldwin | |
| 5,916,071 | A | 6/1999 | Lee | |
| 5,940,994 | A | 8/1999 | Allen | |
| 6,006,449 | A | 12/1999 | Orlowski et al. | |
| 6,029,374 | A | 2/2000 | Herr et al. | |
| 6,065,230 | A | 5/2000 | James | |
| 6,079,126 | A | 6/2000 | Olszewski | |
| 6,282,814 | B1 | 9/2001 | Krafsur et al. | |
| 6,393,731 | B1 | 5/2002 | Moua et al. | |
| 6,449,878 | B1 | 9/2002 | Lyden | |
| 6,457,261 | B1 | 10/2002 | Crary | |
| 6,601,042 | B1 | 7/2003 | Lyden | |
| 6,745,499 | B2 * | 6/2004 | Christensen et al. | 36/29 |
| 6,769,202 | B1 | 8/2004 | Luthi et al. | |
| 6,796,056 | B2 | 9/2004 | Swigart et al. | |
| 7,334,351 | B2 * | 2/2008 | Hann | 36/27 |
| 2001/0049888 | A1 * | 12/2001 | Krafsur et al. | 36/27 |
| 2002/0174567 | A1 | 11/2002 | Krafsur et al. | |
| 2003/0208930 | A1 | 11/2003 | Swigart | |
| 2004/0068892 | A1 | 4/2004 | Wang | |
| 2004/0211088 | A1 * | 10/2004 | Volkart | 36/28 |
| 2007/0193065 | A1 * | 8/2007 | Nishiwaki et al. | 36/27 |

OTHER PUBLICATIONS

Wright, Karen, "Shoeing the Athlete," Discovery, Feb. 2000, pp. 35-36.
Wright, Karen, "Watching Your Steps," Scientific America, undated, pp. 52-57.
Nigg, Benno M., "Impact forces in running," Basic Sciences, 1997, pp. 43-47, Rapid Science Publishers.
Nigg, B.M. et al., "The effect of material characteristics of shoe soles on muscle activation and energy aspects during running," Journal of Blomechanics, 2003, pp. 569-575, Vo. 36, Elsevier Science Ltd.
Marriot, Michel, "The Bionic Running Shoe," The New York Times, May 6, 2004, 5 pages.
Gromer, Cliff, "Supercharged Shoes," PopularMechanics.com, Jul. 2003, pp. 81-85.
"Stability," Runner's World, Jun. 2004, p. 80.
"Spring-loaded running shoes get shocking," inside Triathlon, Jun. 2004, pp. 24-25.
Outside Buyer's Guide, 2003 Annual, 2 pages.
"The Material Edge," Performance Materials Corporation, undated, 9 pages.
Shoe Buyer's Guide, Jun. 2003, pp. 43-56.
"Creating a simply better running shoe," Pearl iZUMi, undated, 1 page.
"Supportive Cushioning," New Balance, undated, 1 page.
"Hyrel Thermoplastic polyester elastomer," DuPont Automotive, Apr. 13, 2004, 1 page.
Nike Shox TL Nike, Sep. 7, 2004, 1 page.
"The Future is Now. WaveSpring Technology is here and it is coming to a shoe near you!" Spire Footwear, Sep. 7, 2004, 4 pages.
"Spring Shoe Review 2004," Running Network, Sep. 7, 2004, 44 pages.
Britek's Thrustor Technology, Britek Footwear, Sep. 7, 2004, 2 pages.
Office Action dated Aug. 8, 2006 for U.S. Appl. No. 10/862,638.
Notice of Allowance dated Sep. 28, 2007 for U.S. Appl. No. 10/862,638.
Communication received from European Patent Office for related EP Application No. 05 758 086.2.
Office Action dated Dec. 5, 2008 for corresponding Chinese Patent Application 2005800185948.

* cited by examiner

SHOE APPARATUS WITH IMPROVED EFFICIENCY

CROSS-REFERENCE

This application is the U.S. national stage application claiming priority of PCT Patent Application No. PCT/US2005/019915, which was filed on Jun. 7, 2005, which is a CIP of now U.S. Pat. No. 7,334,351 U.S. Non-Provisional Patent Application No. 10/862,638 filed on Jun. 7, 2004. U.S. Patent Application Ser. No. 10/862,638 is incorporated by reference herein and made a part of the present specification.

TECHNICAL FIELD

The present invention is related to a shoe with improved efficiency in reducing neuromuscular fatigue. More particularly, the present invention relates to an apparatus using a forefoot hinge and/or one or more suspension elements to improve the efficiency of the use of a shoe.

BACKGROUND OF THE INVENTION

A traditional shoe has an upper which receives a foot of a wearer, and a sole having a midsole and an outer sole, or outsole, connected to the upper. The upper has a front portion for receiving the toes and front portion of the foot of the wearer, and a rear portion for receiving the rear portion of the foot of the wearer including the heel of the wearer. As the wearer walks or runs, the load of the wearer's body is exerted primarily in two separate locations of each of the wearer's feet. In particular, as the wearer walks or runs, the wearer advances one leg forward along with his/her first foot, and upon contact of the outer sole of the shoe with the ground, the heel of the first foot will exert a downward force or load, with a center of such force being exerted generally from the center of the wearer's heel of the first foot. The center of this force exerted by the rear portion of the first foot can be considered the rear center of loading.

As the leg moves from this forward position to a position below the torso and rearward of the torso, this force or load exerted from the heel of the first foot will reduce and transfer to the front portion of the first foot. The load will then transfer to the front center of loading. The front portion of the first foot has a front center of loading. The front center of loading extends generally along a line from the center of the "ball" of the foot toward the exterior of the foot in a path which is generally parallel to the toes.

Using shoes for walking, running, and other activities for an extended period of time, distance, or both can cause fatigue to the wearer, including fatigue to at least the muscles, tendons, ligaments, and cartilage of at least the feet, legs, and torso. This fatigue can be caused by several factors, such as the impact forces resulting from the change in the rate of change of loading or "bottoming out" of conventional shoe materials.

Recent research in running mechanics (see "Impact Forces in Running" by Dr. Benno M. Nigg, 1997) explains that neither the magnitude nor duration of impact forces experienced during running is the primary cause of running fatigue or injuries. The injurious factor in running is a physiological coping mechanism known as "muscle tuning." Muscle tuning is the body's response to the sharp rise in impact force the body experiences during the initial phase of the stride. When impact forces rapidly rise, as during a stride in current running shoes, the body's large muscle groups momentarily tense to prevent the body's soft tissues, large muscle groups and internal organs, from shaking or vibrating in response to the onset of a rapidly-rising impact force. This muscle tuning effect varies according to each runner's physiology and performance profile.

Muscle tuning is the source of localized neuromuscular fatigue. Factors affecting muscle tuning include at least stride length, strength, cardiovascular fitness level, body mass index, weight, fatigue level and tissue hydration level. The muscle tuning effect is often quite pronounced and leads to cumulative fatigue and diminished endurance. These same stride forces have also been implicated as the dominant factor in stress fractures. Therefore, a shoe that allows the wearer to stride with minimal muscle tuning and neuromuscular fatigue is preferred. However, prior shoes do not manage impact forces in such a way as to minimize muscle tuning. Some remedial efforts have been made in an attempt to reduce fatigue.

U.S. Pat. No. 4,881,329, issued Nov. 21, 1989 to Crowley, is directed to an athletic shoe with an energy storing spring. Crowley discloses a spring positioned within the heel portion of the midsole of the shoe. The heel is of conventional profile. Using midsole material above and below the spring diminishes the effectiveness of the spring. In addition, limiting the spring element's location to being laterally within the midsole can cause stability problems.

U.S. Pat. No. 6,282,814 B1, issued Sep. 4, 2001 to Krafsur et al., is directed to a spring cushioned shoe. Krafsur et al. discloses a sole assembly having a first spring disposed within a vacuity in the heel portion of the assembly, and a second spring disposed within a vacuity in the ball portion of the assembly. The vacuities are within the midsole of the shoe. The springs are "wave" springs and are made of a metal material, which can cause the shoe to become heavy and inflexible, thereby reducing the efficiency of the shoe.

U.S. Pat. No. 4,910,884, issued Mar. 27, 1990 to Lindh et al., is directed to a shoe sole incorporating a spring apparatus. Lindh et al. discloses a shoe sole with a cavity in its upper side. Two elliptical springs are situated entirely in the cavity, and fit snuggly but freely in the cavity. A flexible bridge piece fits over the springs. The bridge is a flat spring of uniform thickness, having a planform conforming to the planform of the cavity such that it fits freely but closely in the cavity in the sole. This arrangement suffers from at least the deficiencies of Crowley, and additionally may cause unwanted strains on the user's feet, difficulty in manufacture, and a lack of a cohesive (one piece) feel to this shoe in view of the springs not being integral with the sole, which is of conventional profile.

The present invention is provided to solve these and other problems.

SUMMARY OF THE INVENTION

In one embodiment of the present invention, a shoe is provided which comprises an upper having a generally horizontal bottom wall, the bottom wall having an upper surface and a lower surface, wherein the upper comprises a forward region having a forward center of loading and a rear region having a rear center of loading. The shoe further comprises a sole having a midsole and an outsole. The midsole comprises a suspension element having a generally elongated shape, at least a portion of which is connected to the lower surface of the generally horizontal bottom wall. The suspension element has a center of compression, and the center of compression is generally aligned with at least one of the first and second centers of loading of the upper.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole, the midsole comprising a suspension element having a generally elongated shape and a center of compression. The center of compression is generally aligned with at least one of the first and second centers of loading of the upper. The suspension element further comprises a first upper suspension arm having a first end and a second end, and a second lower suspension arm having a first end and a second end, each of the first and second ends of the respective first and second suspension arms being connected to form the suspension element, and forming first and second sides and a central suspension region therebetween. The central suspension region is at least partially filled with low-density foam.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape and a center of compression, and the center of compression is generally aligned with at least one of the first and second centers of loading of the upper. The suspension element further has a first side and a second side, at least a portion of one of the first and second sides having a generally concave shape inwardly facing toward a line which lengthwise bisects the shoe from a top view.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape and a center of compression. The center of compression is generally aligned with at least one of the first and second centers of loading of the upper, and the generally elongated shape has a flat upper region.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape, a center of compression, a first upper suspension arm having a first end and a second end, and a second lower suspension arm having a first end and a second end. Each of the first and second ends of the respective first and second suspension arms are connected to form the suspension element, and forming first and second sides and a central suspension region therebetween. The center of compression is generally aligned with at least one of the first and second centers of loading of the upper. The lower suspension arm has a downwardly convex region which spans at least a fraction of a distance between the first and second sides.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape, a center of compression, a first upper suspension arm having a first end and a second end, and a second lower suspension arm having a first end and a second end. Each of the first and second ends of the respective first and second suspension arms are connected to form the suspension element, and forming first and second sides and a central suspension region therebetween. The center of compression is generally aligned with at least one of the first and second centers of loading of the upper. The suspension element further comprises a plurality of fibers and a fiber density. The fiber density is higher adjacent to at least one of the first and second sides in relation to the fiber density within at least one other location of the suspension element.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape, a center of compression, a first upper suspension arm having a first end and a second end, and a second lower suspension arm having a first end and a second end. Each of the first and second ends of the respective first and second suspension arms are connected together to form the suspension element, and forming first and second sides and a central suspension region therebetween. The center of compression is generally aligned with at least one of the first and second centers of loading of the upper. The suspension element further comprises a plurality of fibers and a fiber density. The plurality of fibers are generally disposed in at least one of a parallel and a perpendicular orientation to the first and second sides.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape, a center of compression, a first upper suspension arm having a first end and a second end, and a second lower suspension arm having a first end and a second end. Each of the first and second ends of the respective first and second suspension arms are connected together to form the suspension element, and forming first and second sides and a central suspension region therebetween. The center of compression is generally aligned with at least one of the first and second centers of loading of the upper. The suspension element further comprises an aperture located adjacent to at least one of the first and second sides within the first upper suspension arm.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole, the midsole comprising a suspension element having a generally elongated shape, a center of compression, a first upper suspension arm having a first end and a second end, and a second lower suspension arm having a first end and a second end. Each of the first and second ends of the respective first and second suspension arms are connected together to form the suspension element, and forming first and second sides and a central suspension region therebetween. The center of compression is generally aligned with at least one of the first and second centers of loading of the upper. The suspension element further comprises a first molding located proximate at least one of the first and second sides.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole, the midsole comprising a suspension element. The suspension element comprises a center of compression, a first suspension component and a second suspension component. Each suspension component has a generally elongated shape, a first upper suspension arm having a first end and a second end, and a second lower suspension arm having a first end and a second end. Each of the first and second ends of the respective first and second suspension arms of the respective first and second suspension components are connected together to form the respective suspension components, and forming first and second sides and a central suspension region therebetween for each of the respective suspension components. The center of compression is generally aligned with at least one of the first and second centers of loading of the upper. The shoe further comprises a ridged support located between the suspension element and the upper for distributing loading between the first and second suspension components of the suspension element.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape, at least a portion of which is connected to the outsole. The suspension element has a center of compression. The center of compression is generally aligned with at least one of the first and second centers of loading of the upper.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape, a center of compression, and first and second lateral sides. The center of compression is generally aligned with at least one of the first and second centers of loading of the upper. The midsole comprises a side contour. At least one of the lateral sides follows at least a portion of the side contour of the midsole.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape, a center of compression, and first and second lateral sides. The center of compression is generally aligned with at least one of the first and second centers of loading of the upper. The midsole comprises a side contour. At least one of the lateral sides extends laterally beyond at least a portion of the side contour of the midsole.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole having a midsole and an outsole. The midsole comprises a suspension element having a generally elongated shape, a center of compression, and upper and lower lateral sides. The center of compression is generally aligned with at least one of the first and second centers of loading of the upper. The midsole comprises a side contour. At least one of the lower lateral sides extends laterally beyond the at least one of the upper lateral sides.

In another embodiment, the shoe comprises an upper having a generally horizontal bottom wall, the bottom wall having an upper surface and a lower surface, wherein the upper comprises a forward region having a forward center of loading, the forward region having a width, wherein the forward center of loading is represented by a line which traverses the width of the forward center of loading at an angle from the width, and wherein the upper comprises a rear region having a rear center of loading. The shoe further comprises a sole having a midsole and an outsole, the midsole comprising a suspension element having a generally elongated shape, a center of compression, and first and second lateral sides, wherein the center of compression traverses the suspension element from the first lateral side to the second lateral side, and wherein the center of compression is generally aligned with the forward center of loading.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole connected to the upper and comprising a generally vertical hinge slit extending the lateral width of the sole. The hinge slit has a horizontal component and a vertical component. The hinge slit extends from a bottom surface of the sole through at least twenty percent of the vertical component of the sole. At least a portion of the horizontal component of the hinge slit is located between a midpoint between the forward center of loading and the rear center of loading, and the forward center of loading from a bottom view.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole connected to the upper and comprising an openable gap extending the lateral width of the sole. The openable gap has a horizontal component and a vertical component, and extends along a path which generally follows at least a portion of an upper surface of the compression element beginning from a bottom surface of the sole through at least ten percent of the sole in a vertical direction. At least a portion of the horizontal component of the openable gap is located between a midpoint between the forward center of loading and the rear center of loading, and the forward center of loading from a bottom view.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole connected to the upper and comprising an openable gap extending the lateral width of the sole. The openable gap has a horizontal component and a vertical component, and extends along a path beginning from a bottom surface of the sole through at least ten percent of the sole in a vertical direction. At least a portion of the horizontal component of the openable gap is located between a midpoint between the forward center of loading and the rear center of loading, and the forward center of loading from a bottom view.

In another embodiment, the shoe comprises an upper having a generally horizontal bottom wall, the bottom wall having an upper surface and a lower surface. The upper comprises a forward region having a forward center of loading and a rear region having a rear center of loading. The shoe further comprises a sole connected to the upper and comprising an openable gap extending the lateral width of the sole. The openable gap has a horizontal component and a vertical component, and extends along a path which generally follows at least a portion of an upper surface of the suspension element.

A method of manufacturing a suspension element for a shoe is also described. The method comprises the step of providing a die having a length, a width and a thickness, the length accommodating a plurality of suspension elements. The method further comprises the steps of wrapping a plurality of coated or wetted fibers around the width of the die to form the suspension elements, drying or curing the fibers to a substantially integrated form, and separating the plurality of suspension elements into independent suspension elements.

In another embodiment, the shoe comprises a suspension element having ridges molded or formed into the upper and lower surfaces of the suspension element.

In another embodiment, the shoe comprises shaped pockets, recesses or receiving areas in the upper surface of the sole to accommodate the heel and to accommodate at least the first metatarsal ball of a user's foot.

In another embodiment, the shoe comprises a suspension element having a foam element running from the first lateral side to the second lateral side in the area of the center of compression of the suspension element. The foam element can take the form of an over-travel bumper, which is connected to only the lower inner surface of the suspension element, to minimize overflex damage to the suspension element.

In another embodiment, the shoe comprises an upper and a midsole. The midsole has a profile or contour of the lower surface that follows an arc or elliptical path from the center of the heel to the extreme rear of the heel, in a smooth continuous curve or arc, without a corner or sharp break in contour at or near the extreme rear of the heel. This contour facilitates a more natural gait, like a barefoot stride.

A conventional heel features a longitudinally horizontal segment under the center of the heel with a break, usually 90 degrees, at the extreme rear of the heel joined to a vertical segment which leads directly to the heel counter at the rear of the shoe upper. The present embodiment features a continuous curve from the center of the heel up to the top rear of the midsole, with no horizontal or vertical segments and no distinct break at the horizontal ground plane.

Other features and advantages of the invention will be apparent from the following specification taken in conjunction with the following drawings.

DETAILED DESCRIPTION

Figure 1:
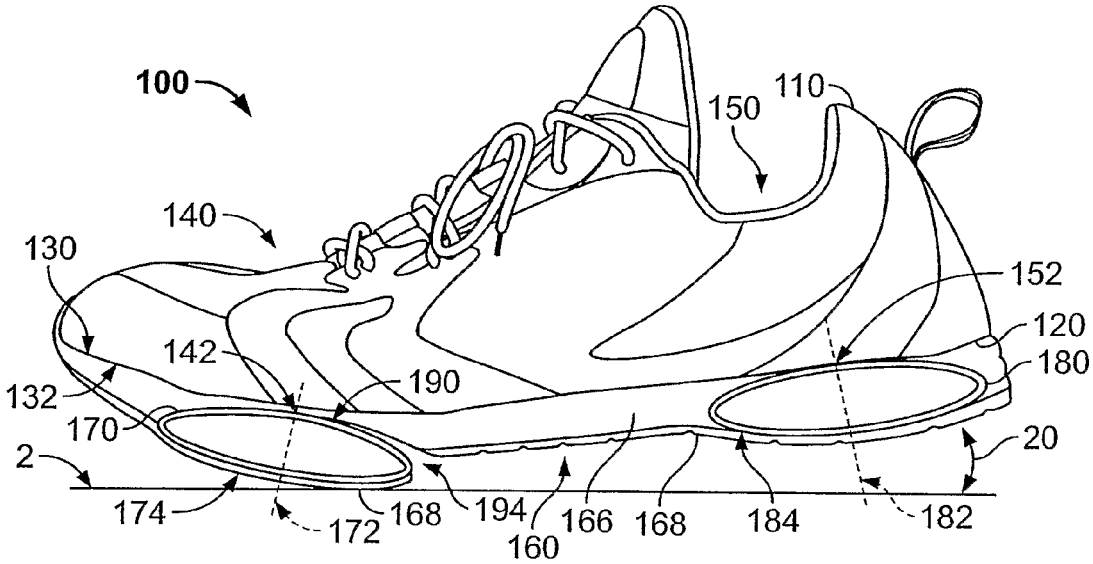
FIG. 1 is a side view of one embodiment of a shoe of the present invention.

While this invention is susceptible of embodiment in many different forms, there are shown in the drawings and herein described in detail preferred embodiments with the understanding that the present disclosure is to be considered an exemplification of the principles of the invention and is not intended to limit the broad aspect of the invention to the embodiments illustrated.

The composite suspension elements of the present invention are not "springs" in any simplistic sense. Their function is to guide and decelerate the wearer in a linear fashion, in order to provide a low or zero change in rate of loading throughout the stride, as will be discussed further below. The suspension elements may be a single piece composite or made in two halves, upper and lower, which may provide more linearity and effective suspension travel at a slight increase in element weight. For ride quality and motion control purposes, the suspension elements may feature small cutouts, ridges, profile shaping or asymmetrical fiber positioning to alter the flex pattern upon deflection, as will be described in greater detail below. Optionally, small columns or shapes of compressible resilient foam may be used to tailor motion control for stability, pronation or supination.

Foam materials as used in conventional footwear, for example material such as that which is used within SHOX shoes made by NIKE, are high hysteresis materials. This prior material expands relatively slowly from a compressed state. Thus, a foam midsole "feels" more sluggish and less responsive to the wearer. The composite materials used in the present invention are lower hysteresis materials. Lower hysteresis materials rebound more rapidly from a deflected position. Thus, the shoe of the present invention feels lively and energetic to the wearer.

The present invention also allows the wearer to experience a very low or zero change in the rate of loading throughout the stride. This is the optimum condition for maximum muscular endurance and minimum fatigue. By contrast, conventional footwear materials impart a higher rate of loading, which causes the large muscle groups of the legs, back and abdomen to work harder and fatigue sooner.

In addition, the shoe of the present invention acts very much like a full-suspension bicycle, which dynamically couples the energy and motion of the wearer's stride to allow the wearer to achieve a "barefoot gait." The wearer's stride is similar to that of a barefoot stride on grass or another soft surface. The sole profile, with upturned rocker at the heel, facilitates a barefoot stride in this footwear. The stride is unforced and natural, which is the most efficient for that wearer. By contrast, conventional shoes cause the wearer to adapt to the shoes' biomechanics, which are often less than optimum for the individual.

The shoe of the present invention also has a forefoot hinge or openable gap for improving the shoe's efficiency. The hinge can be coupled with the suspension elements for dynamic application to the wearer's stride, from heel-in to toe-off. The hinge and suspension elements alone and/or in combination act to bring a high degree of flexibility to the system. Thus, a natural gait is provided similar to barefoot walking and reduces fatigue and injury in the plantar arch of the foot, Achilles tendon, calf and/or hamstring.

Figure 2:
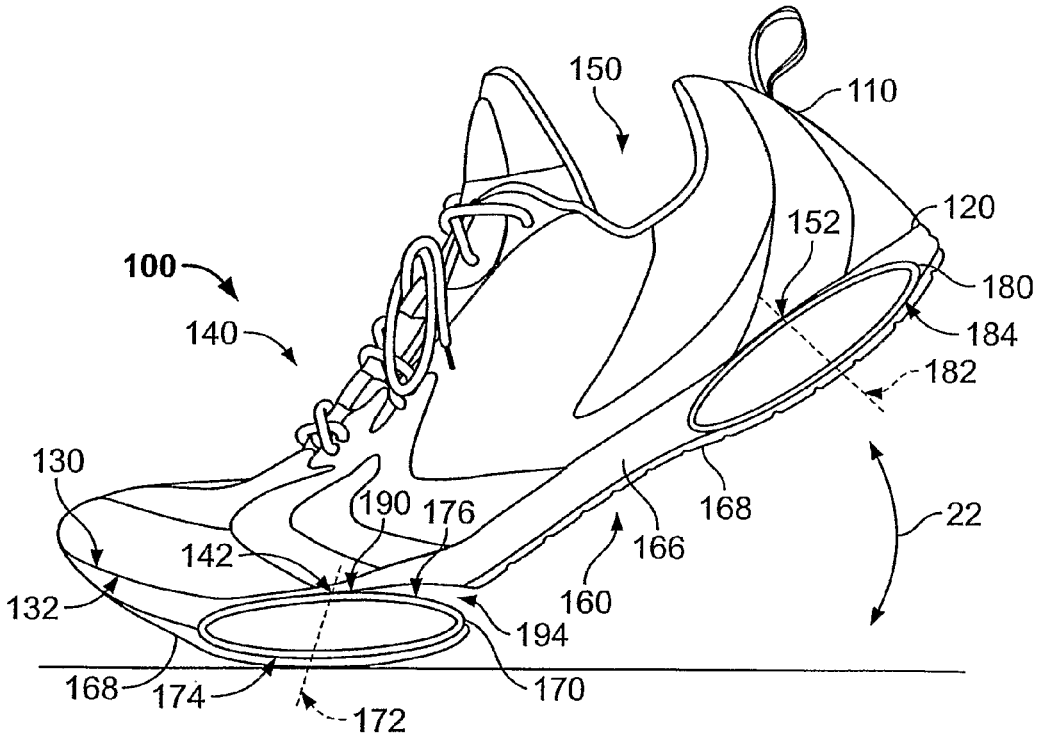
FIG. 2 is a side view of the shoe of FIG. 1 with the heel of the shoe in an upward position.

Referring to FIGS. 1 and 2, there is shown a shoe 100 having an upper 110. The upper 110 has a generally horizontal bottom wall 120. The bottom wall 120 has an upper surface 130 and a lower surface 132. The upper 110 comprises a forward region 140 having a forward center of loading 142 and a rear region 150 having a rear center of loading 152. The shoe 100 further has a sole 160 having a midsole 166 and an outsole 168. Portions of the midsole 166 and the outsole 168 can be made of various different known materials, such as plastic, EVA foam, rubber, and other known materials.

In the embodiment of FIGS. 1 and 2, a first suspension element 170 and a second suspension element 180 are integrated within the midsole. The suspension elements 170,180 each have a generally elongated shape. In the embodiment shown, at least a portion of the second suspension element 180 is connected to the lower surface 132 of the generally horizontal bottom wall 120. Each of the first and second suspension elements 170,180 have a center of compression 172,182, respectively. The centers of compression 172,182 are generally aligned with the respective centers of loading 142,152 of the upper 110. The suspension elements 170,180 compress when the user's load is exerted during use of the shoe 100. As is shown and described in more detail below in relation to FIG. 11, the suspension elements 170,180 allow loading/impact forces to build more linearly and release more symmetrically as compared to prior shoes. The preferred shape of the suspension elements 170,180 is an elliptical or oval shape. However, as will be shown and described further below, the suspension elements 170,180 can have various shapes and constructions.

In the embodiment of FIGS. 1 and 2, the shoe 100 preferably has a hinge 190 and an openable gap 194 for allowing sole 160 of the shoe 100 to bend more naturally with the natural bend of the user's foot. In the embodiment of FIG. 1, the shoe 100 is in a position after the user of the shoe 100 has contacted the heel of the shoe 100 with the ground 2, and after the user has begun to raise the heel initially off the ground 2 at an initial angle 20. In the embodiment of FIG. 2, the shoe is in a position after the user of the shoe 100 has significantly raised the heel of the shoe 100 off the ground 2 at a toe angle 22. As the user moves through a walking or running stride, the initial angle 20 increases to the toe angle 22, and the openable gap 194 transitions from a generally closed openable gap 194, as shown in FIG. 1, to an open openable gap 194, as shown in FIG. 2, about the hinge 190. The hinge 190 and openable gap 194 assist in reducing stresses on the user's foot as the shoe 100 and sole 160 bend during walking/running strides. In turn, the reduction in these stresses assists in reducing muscle fatigue and improves the efficiency of the shoe 100.

As will be described in more detail below in relation to FIGS. 40 and 42, the suspension element 170 of the forward region 140 of the shoe 100 can be integrated into the midsole at a generally perpendicular angle to a line which runs lengthwise down the center of the shoe from a top view (not shown), as can be understood from at least FIG. 1 in combination with other FIGS. Alternatively, the suspension element 170 of the forward region 140 of the shoe 100 can be integrated into the midsole at an angle other than an angle which is perpendicular to a line which runs lengthwise down the center of the shoe from a top view (not shown), as can be understood from at least FIG. 8. In this way, the forward center of loading can be represented by a line which traverses the width of the forward center of loading at an angle. The angle is formed in relation to a line which is perpendicular to a line which runs lengthwise down the center of the shoe from a top view (not shown), and which follows the full lateral front center of loading for forces exerted by a user's foot. The front center of compression 172 is thus generally aligned with the front center of loading 142 across the full width of the upper 110 and may be positioned to achieve maximum energy efficiency and fatigue reduction. In the embodiment of FIGS. 1 and 2, the outsole 168 is connected to a lower exterior surface 174,184 of the suspension elements 170,180, respectively of the midsole 166.

In at least the embodiment shown in FIGS. 1 and 2, the openable gap or hinge slit 194 can extend the lateral width of the sole 160. The openable gap 194 can have both a horizontal component and a vertical component, and can extend along a path which generally follows at least a portion of an upper surface 176 of the suspension element 170.

Figure 46:
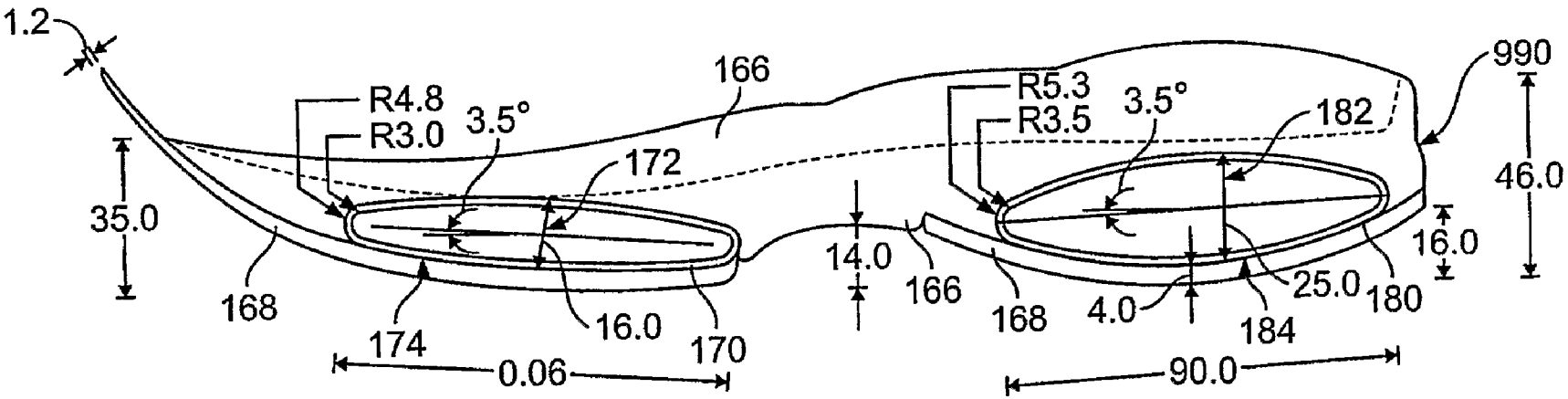

The toe rocker profile of FIG. 2 flows into the suspension element and the heel profile incorporates a rocker contour that follows the elliptical suspension element 180. In one particular embodiment of FIG. 2, FIG. 46 shows the midsole 166 of a test shoe with particular dimensions for the midsole 166 and suspension elements 170,180. The midsole 166 in this embodiment can be used without suspension elements 170, 180 as well, with similar dimensions for the midsole 166, as shown. The dimensions in FIG. 46, which are the non-element numerals, are shown in millimeters for this embodiment. The dimensions are representative and not the only way to implement the present invention. The dimensions of the heel portion of the midsole 166 are indicative of the toe rocker profile aspect of the present invention. The rocker contour is shown through the continuous curve along the outsole 168 of the heel portion. With or without the suspension element 180, this curve follows an arc or elliptical path from the center of the heel to the extreme rear of the heel, in a smooth continuous curve or arc, provides for improved running efficiency and facilitates a more natural gait. Thus, the outsole in FIGS. 2 and 46 has a heel section with a generally continuous arc curvature from at least the rear center of loading 182 to the rear end 990. In one particular embodiment, the radius of the lower exterior surface 184 of the rear suspension element 180 is 85 millimeters. The outsole generally follows this curvature, with a similar radius, taking into account the thickness of the outsole, which in the FIG. 46 embodiment is about 4 millimeters. In one particular embodiment, the radius of lower exterior surface 174 of the front suspension element 170 is 130 millimeters. The outsole generally follows this curvature, with a similar radius, taking into account the thickness of the outsole, which in the FIG. 46 embodiment is also about 4 millimeters in the area of the front suspension element narrowing to about 1.2 millimeters toward the front end of the shoe.

Figure 3:
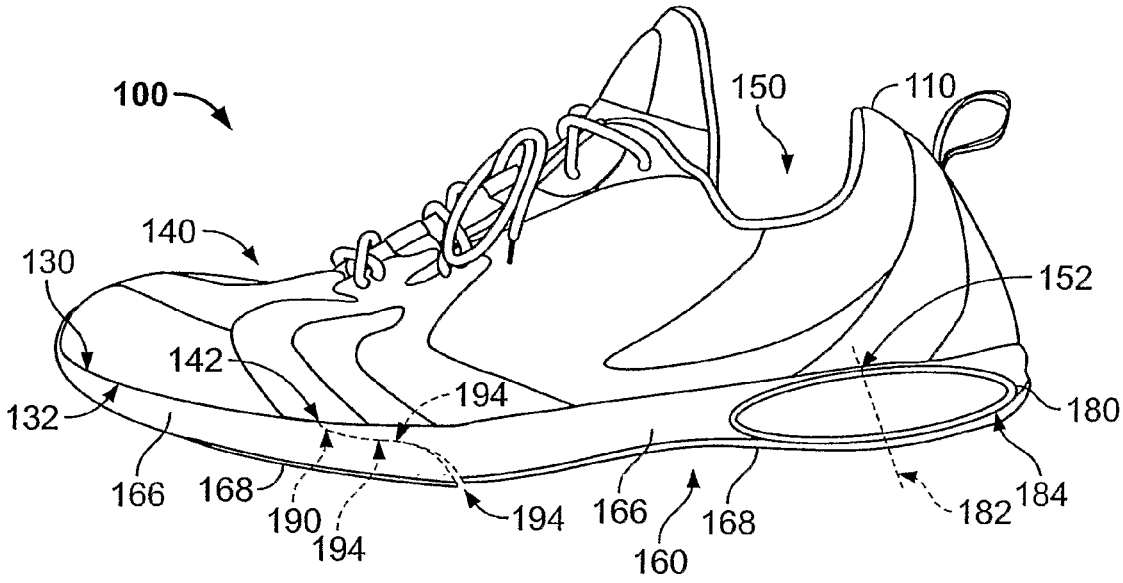
FIG. 3 is a side view of another embodiment of the shoe of the present invention with one embodiment of a rear suspension element and one embodiment of a hinge or openable gap.
Figure 4:
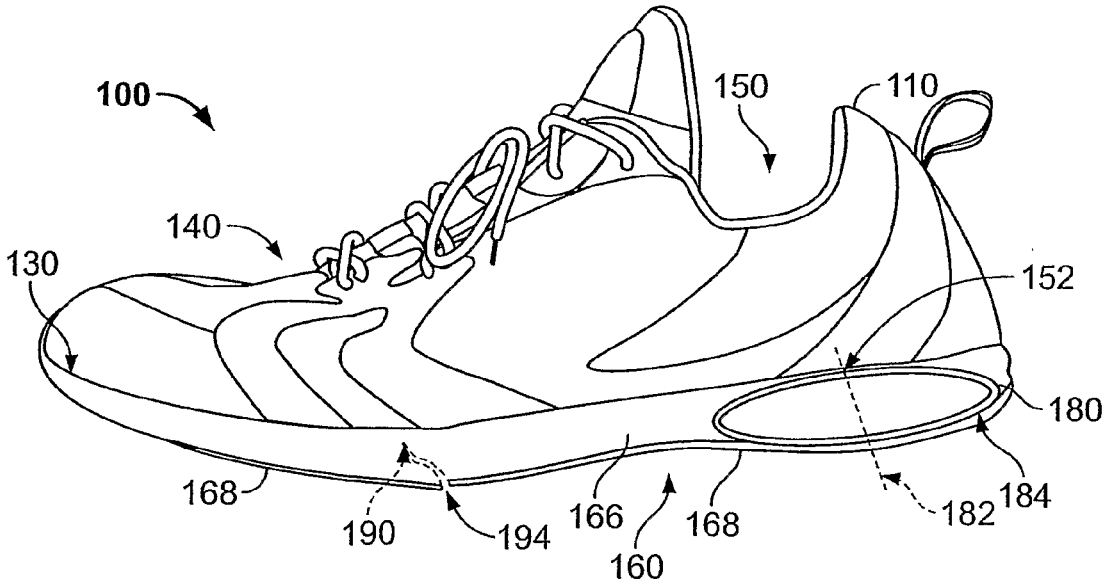
FIG. 4 is a side view of the shoe of FIG. 3, but with another embodiment of the hinge or openable gap.

With reference to at least the embodiments shown in FIGS. 3 and 4, these embodiments have several of the features of the embodiments of FIGS. 1 and 2, but without the first suspension element. The embodiments of the shoe 100 shown in FIGS. 3 and 4 alternatively have a hinge 190 and an openable gap 194, which can be of different orientations and have different vertical and/or horizontal components. Specifically, the openable gap 194 of FIG. 3 comprises an initial vertical component located at and near the outsole 168, which can extend the lateral width of the sole. The openable gap then includes a curve and comprises a generally horizontal component, ending up with a generally vertical component near the bottom surface 132 of the upper 110. Thus, the hinge slit 194 extends from a bottom surface 168 of the sole 160 through at least ten percent or at least twenty percent of the sole 160 in a vertical direction. At least a portion of the horizontal component of the hinge slit 194 is located between a midpoint between the forward center of loading 142 and the rear center of loading 152, and the forward center of loading 142.

Figure 8:
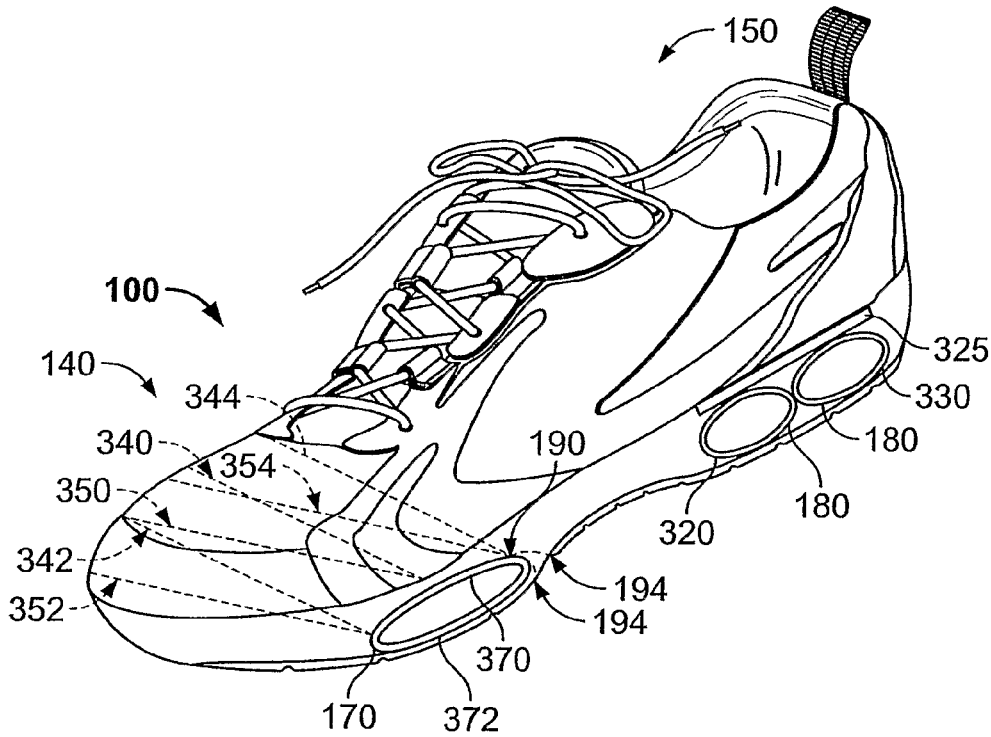
FIG. 8 is a perspective view of another embodiment of the shoe of the present invention showing two potential orientations for the positioning of the front suspension element.

Similar to the front suspension element of FIG. 1, as further understood from viewing of at least FIG. 8, the openable gap or hinge slit 194 and/or the hinge 190 can be integrated into the midsole 166 and outsole 168 at a generally perpendicular angle to a line which runs lengthwise down the center of the shoe from a top view (not shown). Alternatively, the openable gap or hinge slit 194 and/or the hinge 190 of the forward region 140 of the shoe 100 can be integrated into the midsole 166 and outsole 168 at an angle other than an angle which is perpendicular to a line which runs lengthwise down the center of the shoe from a top view (not shown), as can be understood from at least FIG. 8. In this way, the forward center of loading can be represented by a line which traverses the width of the forward center of loading at an angle. The angle is formed in relation to a line which is perpendicular to a line which runs lengthwise down the center of the shoe from a top view (not shown), and which follows the full lateral front center of loading for forces exerted by a user's foot. As shown in FIG. 3, the hinge 190 is located proximate the front center of loading 142 and extends across the full width of the upper 110 at a perpendicular angle or at another angle, other than perpendicular, to the line which runs lengthwise down the center of the shoe from a top view (not shown), to preferably align the hinge 190 with the natural bend of the user's foot and the respective loading across the width of the front region 140 of the sole 160 of the shoe 100 (see at least FIG. 8).

Figure 5:
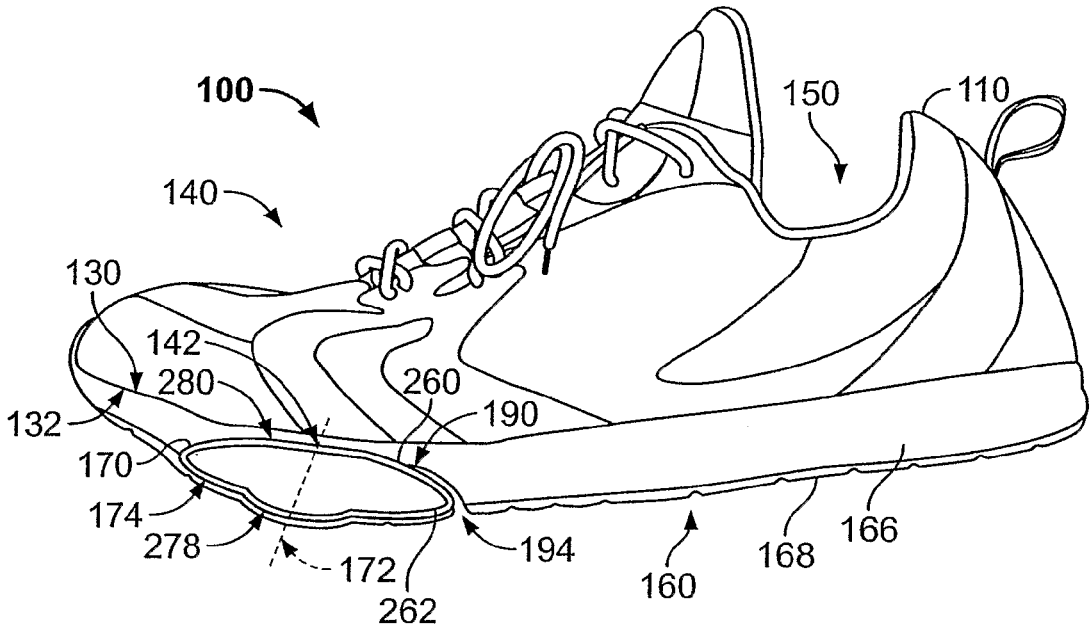
FIG. 5 is a side view of another embodiment of the shoe of the present invention with one embodiment of a front suspension element and one embodiment of a hinge or openable gap.
Figure 23:
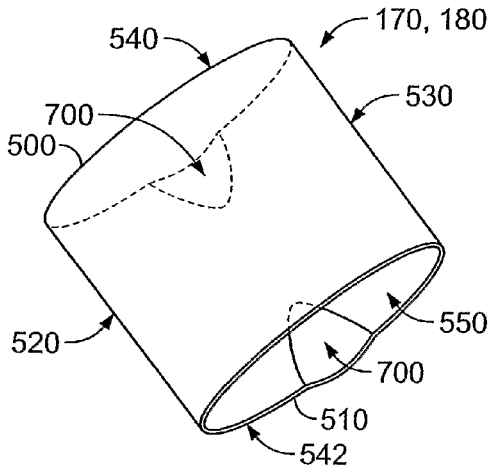
FIG. 23 is a perspective view of one embodiment of a suspension element of the present invention.

Referring to FIG. 5, a further embodiment of the shoe 100 is shown with a further embodiment of the suspension element 170. Specifically, the suspension element 170 is generally elongated and has an upper arm 260 and a lower arm 262. The upper arm 260 has a flat upper portion 280 and the lower arm 262 has a protrusion 278. The flat upper portion 280 can extend across the full lateral width of the front region 140 of the shoe 100. The suspension element 170 has first and second lateral sides (shown and described in figures below). The protrusion 278 can extend across the full lateral width of the front region 140 of the shoe 100 (from the first lateral side to the second lateral side), or the protrusion 278 can be split into first and second protrusions 278 which can take the form of a portion of a conical shape, as shown in FIG. 23. These features of the suspension element 170 can assist in tuning the suspension element 170 and the overall shoe 100 to achieve a more efficient shoe 100 for the particular user and use of the shoe 100. The shoe 100 of FIG. 5 further has a hinge 190 and a hinge slit or openable gap 194 for improved bendability of the shoe 100 with the natural bend of the user's foot. As in prior embodiments, outsole 168 is connected to the lower arm, and in this embodiment, the protrusion 278 of the suspension element 170. In addition, the center of compression 172 of the suspension element 170 is generally aligned with the front center of loading 142 of the shoe 100, and in the present embodiment, the center of compression 172 can generally run through the center of the flat upper portion 280 and the protrusion 278.

Figure 6:
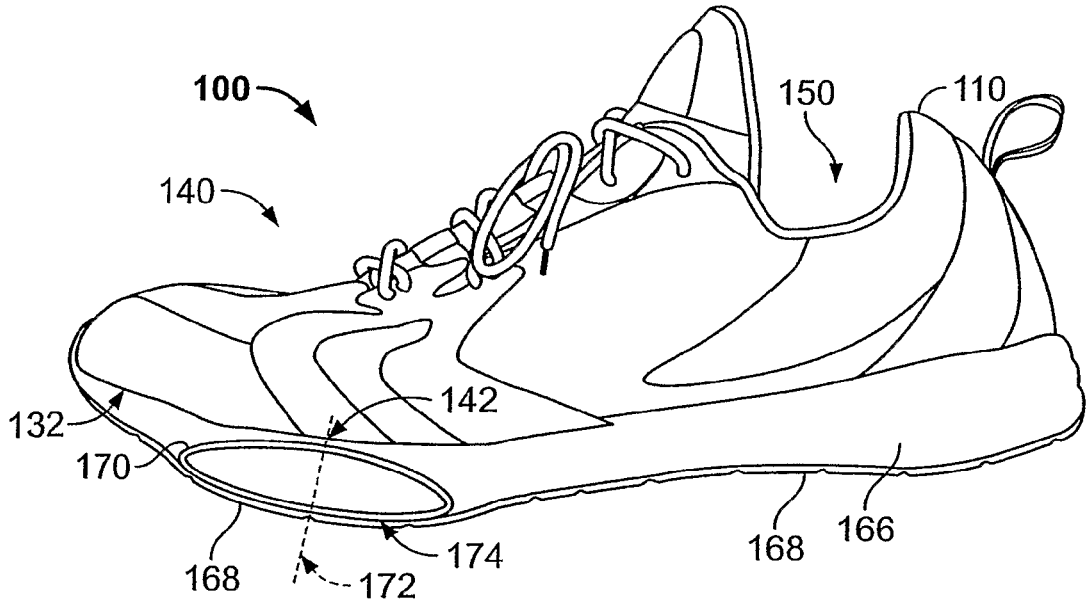
FIG. 6 is a side view of another embodiment of the shoe of the present invention, with one embodiment of a front suspension element relationally positioned with the outsole and upper.

The embodiment of the shoe 100 of FIG. 6 can include many of the features of the prior embodiments, but in a more simplified form. In particular, the shoe 100 of FIG. 6 has a generally elongated suspension element 170 which can be connected to the outsole 168. The suspension element 170 has a center of compression 172 which is generally aligned with the front center of loading 142. As shown in all of the prior embodiments, the lateral sides of the suspension element 170 are visible from a side view of the shoe 100. A wider suspension element 170 used within the shoe 100 can increase stability of the shoe 100. Thus, the visibility of the lateral sides of the suspension element 170 from a side view indicates that the lateral width is at least flush with the sides of the midsole 166.

Figure 7:
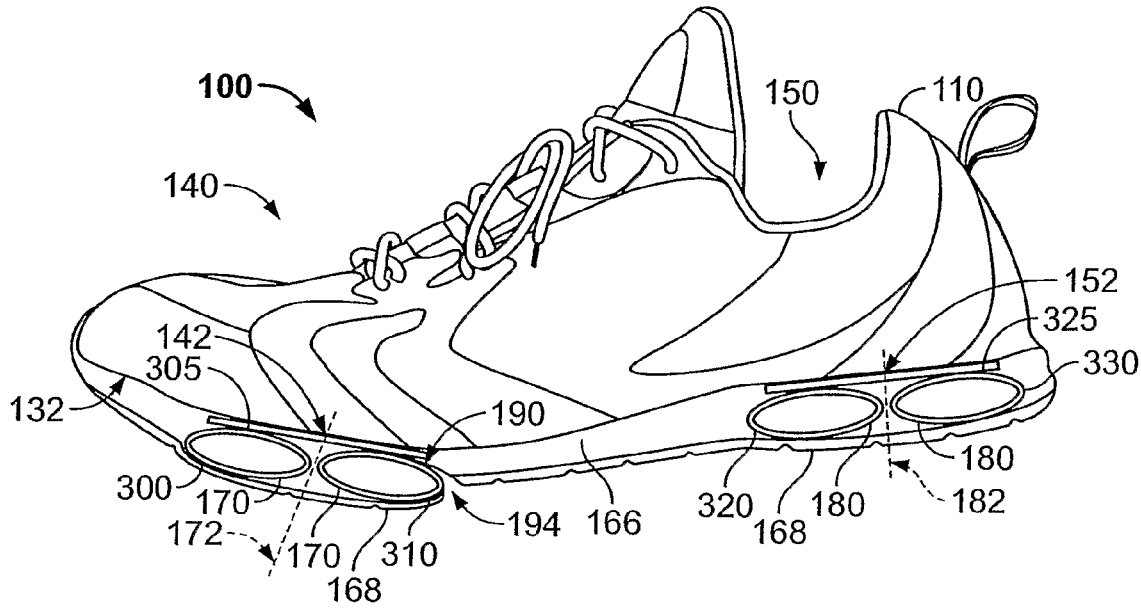
FIG. 7 is a side view of another embodiment of the shoe of the present invention with one embodiment of the front suspension element, rear suspension element, and hinge or openable gap.
Figure 9:
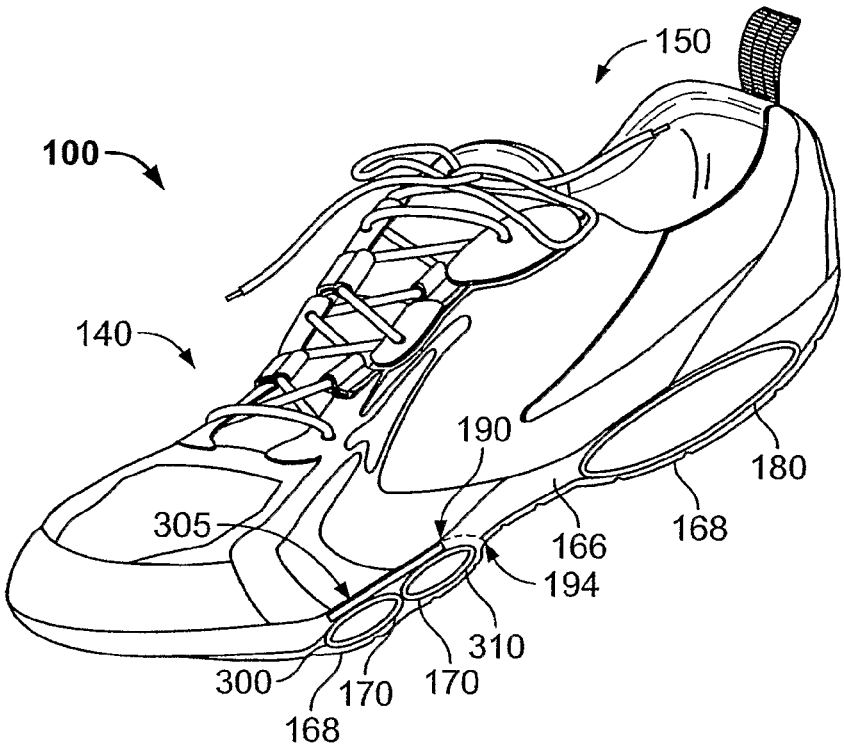
FIG. 9 is a perspective view of another embodiment of the shoe of the present invention with one embodiment of the front suspension element, rear suspension element, and hinge or openable gap.

Referring to the embodiments of the shoe 100 of FIGS. 7, 8 and 9, the shoe 100 has similar features of prior embodiments. However, the suspension elements can each comprise a first suspension component and a second suspension component, each suspension component having a generally elongated shape. In particular, the first suspension element 170 in FIG. 7 has a first suspension component 300 and a second suspension component 310. Likewise, the second suspension element 180 in FIG. 7 has a first suspension component 320 and a second suspension component 330. A first ridged support 305 is provided for assisting in supporting the user's foot within the front region 140 of the upper 110. The first ridged support 305 disperses the loading which occurs in this region among the first suspension component 300 and the second suspension component 310. The first and second suspension components 300,310 can be of different compositions to compensate for each of their locations in relation to where more or less loading will occur within the stride of a user of the shoe 100. For example, first suspension component 300 may be made of fewer fibers and have a lower threshold before significant compression occurs in view of the potential for less loading to occur forward of the front center of loading 142. Likewise, the second suspension component 310 can be made of more fibers and/or stronger with a higher threshold before significant compression occurs, or vice versa depending on the needs of the designer and the user. Likewise, a second ridged support 325 is provided for assisting in supporting the user's foot within the rear region 150 of the upper 110. The second ridged support 325 disperses the loading which occurs in this region among the first suspension component 320 and the second suspension component 330. The first and second suspension components 320,330 can be of different compositions to compensate for each of their locations in relation to where more or less loading will occur within the stride of a user of the shoe 100. For example, first suspension component 320 may be made of fewer fibers and have a lower threshold before significant compression occurs in view of the potential for less loading to occur forward of the rear center of loading 152. Likewise, the second suspension component 330 can be made of more fibers and/or stronger with a higher threshold before significant compression occurs, or vice versa, depending on the needs of the designer and the user.

Each suspension component 300,310,320,330 has a first upper suspension arm having a first end and a second end, and a second lower suspension arm having a first end and a second end. Each of the first and second ends of the respective first and second suspension arms of the respective first and second suspension components are connected together to form the respective suspension components 300,310,320,330. Each component has a central suspension region between the respective first upper and second lower suspension arms. As in prior embodiments, the first and second centers of compression 172,182 can be generally aligned with the first and second centers of loading 142,152 respectively. In the embodiment shown, the supports 305,325 are connected to the lower surface 132 of the bottom wall (or shoe insert) 120 of the upper 110. The shoe 100 of FIG. 7 further has a hinge 190 and an openable gap 194 as generally shown and described in prior embodiments.

Referring in more detail to the embodiment of the shoe 100 of FIG. 8, the rear region 150 or portion of the shoe 100 is similar to the rear region or portion of the shoe 100 of FIG. 7. In addition, the front region 140 or portion of the shoe 100 of FIG. 8 is similar to the front region 140 or portion of the shoe 100 of FIG. 7, except that a hinge 190 and alternative embodiments of an openable gap 194 are located within the sole 160 of the shoe 100. As briefly mentioned above, and as shown in FIGS. 40 and 42, the first suspension element can traverse the width 340 or center of compression 340 of the first or front suspension element 170. The front suspension element 170 has a first upper arm 370 and second lower arm 372 each having a first and second end connected together to form the suspension element 170. As mentioned, in one embodiment of FIG. 8, the suspension element 170 traverses the width 340 of the front region 140 of the shoe 100, and the traverse of the suspension element 170 is shown by the first end 342 and the second end 344 traversing the width of the shoe 100. In this embodiment, the center of compression 340 of the suspension element 170 is at an angle which is perpendicular to a line 960 which travels the length of the shoe 100 through the center of the shoe. In another embodiment of FIG. 8, the suspension element 170 traverses the front region 140 of the shoe 100, and the traverse of the suspension element 170 is alternatively shown by the first end 352 and the second end 354 traversing the width of the shoe 100, but at an angle 982 to the width 340 of the front region 140 of the shoe 100. In this embodiment, the center of compression 350 of the suspension element 170 is at an angle 980 other than perpendicular to a line 960 which travels the length of the shoe 100. In this alternative embodiment, the center of compression follows the natural bend of the foot of user for improved reduction in fatigue and improved efficiency of the shoe 100.

Referring to the embodiment of the shoe 100 of FIG. 9, the rear region 150 or portion of the shoe 100 is similar to the rear region 150 or portion of the shoe 100 of FIGS. 3 and 4. In addition, the front region 140 or portion of the shoe 100 of FIG. 9 is similar to the front region 140 or portion of the shoe 100 of FIG. 7, except that a hinge 190 and alternative embodiments of an openable gap 194 are located within the sole 160 of the shoe 100.

Figure 10:
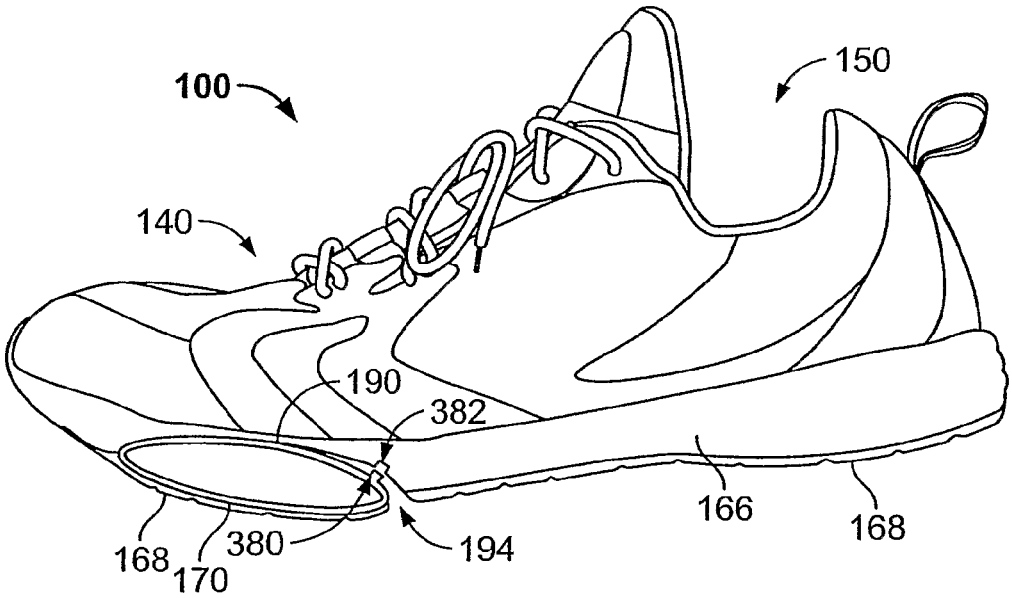
FIG. 10 is a side view of another embodiment of the shoe of the present invention with one embodiment of a front suspension element and one embodiment of a hinge or openable gap.

Referring to the embodiment of the shoe 100 of FIG. 10, the rear region 150 or portion of the shoe 100 is similar to the rear region 150 or portion of the shoe 100 of FIGS. 5 and 6. In addition, the front region 140 or portion of the shoe 100 of FIG. 9 is similar to the front region 140 or portion of the shoe 100 of FIGS. 1 and 2. However, a gap protrusion 380 and a protrusion recess 382 are provided for preventing debris or dirt from entering the openable gap 194. The gap protrusion 380 and protrusion recess 382 can be located proximate the opening of the openable gap 194 within the midsole 166 or as a part of the outsole 168 or a combination of both. As shown in FIG. 10, the gap protrusion 380 is a part of the suspension element itself, which could traverse the width of the first upper arm of the suspension element 170. The protrusion 380 could also be located on the end of the arms of the suspension element 170. The gap protrusion 380 can alternatively be a part of the midsole instead of the suspension element 170, depending on the construction of the openable gap 194. Further, in one embodiment, the protrusion recess 382 is located within the midsole 166, but could also be within the outsole 168 or both. The gap protrusion 380 and protrusion recess 382 can take various shapes such as for example being square or cylindrical in nature. In addition, a plurality of gap protrusions and protrusion recesses could be provided (not shown), which may improve the prevention of debris or dirt from entering the openable gap 194.

Figure 11:
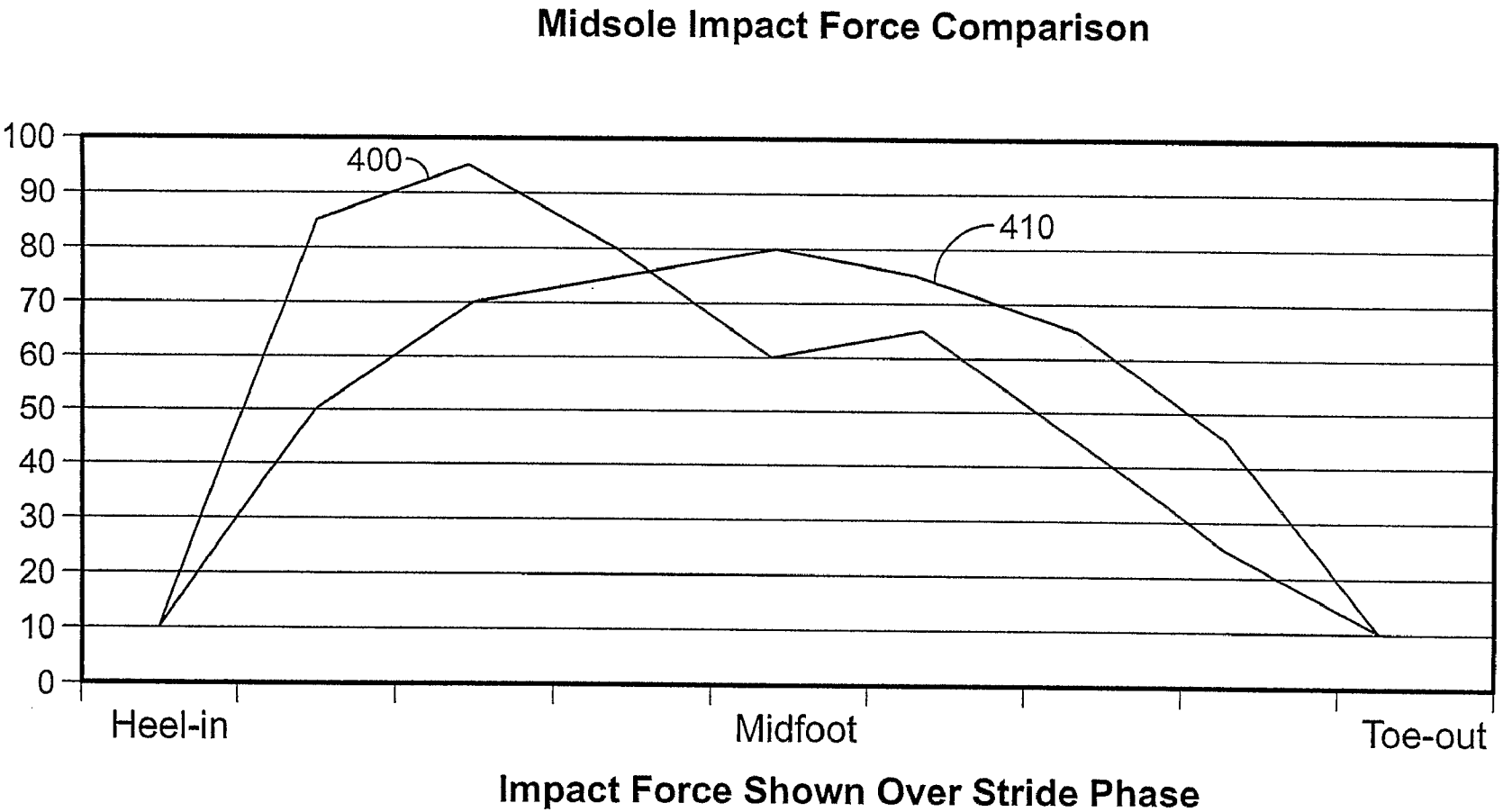
FIG. 11 is a graph comparing prior shoe performance to theoretical shoe performance for the present invention.

Referring to FIG. 11, a midsole impact force comparison graph is shown which depicts theoretical midsole impact force curves for prior midsoles vs. the shoe of the present invention. In particular, the first force curve 400 of prior midsoles shows that the heel-in portion of a runner's stride for the shoe endures significantly higher levels of impact forces as compared to a second force curve 410 for the shoe of the present invention. In other words, the conventional shoe peaks early in the force curve, which causes the muscle tuning effect to activate, leading to overworking of the large muscle groups of the legs, torso and back. As the midfoot portion of a runner's stride is reached, the force curves converge. However, the detrimental impact damage has been done for the stride. For a runner's stride while using the shoe of the present invention, the second force curve 410 is significantly more symmetrical and tops out at the midfoot portion of the runner's stride. The second force curve 410 builds gradually and releases more symmetrically, which feels somewhat more like an elliptical trainer than typical running. The muscle tuning effect is diminished with a corresponding reduction in neuromuscular fatigue.

The preferred embodiments of the shoe 100 of the present invention with first and second suspension elements 170,180 are designed to deliver a linear loading rate while the midsole thereof is deflected during a runner's typical stride. This lower rate of loading associated with the second force curve 410 and concurrent "suspension travel" act to diminish the duration and severity of the muscle tuning effect in walking and running. One goal of these embodiments is that only the suspension elements deflect during the stride. Other portions of the shoe, such as the remainder of the midsole, are minimally compressible for increased efficiency. This arrangement is preferred when trying to reduce "muscle tuning" reactions to impacts and other obstacles.

FIGS. 12-33 show various alternative embodiments of a suspension element 170,180 (or suspension component 300, 310,320,330) for use in the various embodiments of the shoe of the present invention. All of these embodiments can be considered to have a first upper suspension arm 500 and a second lower suspension arm 510. Each suspension arm 500, 510 has a first end 520 and a second end 530, and each of the first ends 520 and each of the second ends 530 or the first and second arms 500,510 are connected together forming open first and second lateral sides 540,542 and a hollow suspension region 550 therebetween, extending from the first lateral side 540 to the second lateral side 542 of the suspension element 170,180. The suspension elements 170,180 can be manufactured by preparing each of the first and second arms 500,510 and then joining each of the arms 500,510 together at the first and second ends 520,530. However, alternatively, the suspension elements 170,180 are manufactured as a single integral piece or construction, as will be explained further below and shown in FIG. 27. Each of the suspension elements 170,180 have a center of compression 560. It should be understood that although the embodiments of the suspension elements 170,180 shown in these FIGS. have a generally rectangular shape from a top view, the suspension elements 170,180 can have different shapes. For example, the suspension elements 170,180 could have a parallelogram shape from a top view, which would be more suitable for the alternative embodiment of the suspension element 170 of FIG. 8 with first and second ends 352,354 and center of compression 350.

Figure 12:
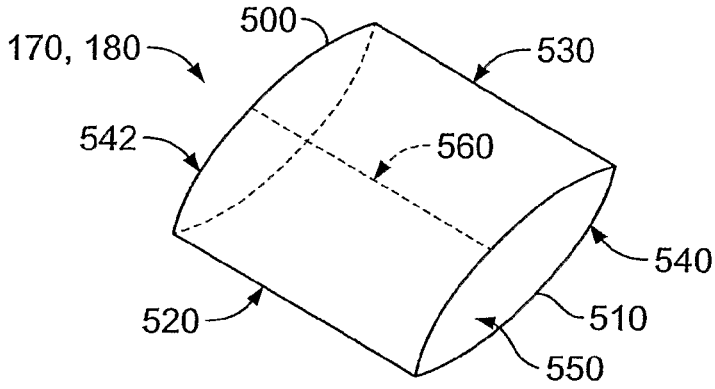
FIG. 12 is a perspective view of one embodiment of a suspension element of the present invention.
Figure 13:
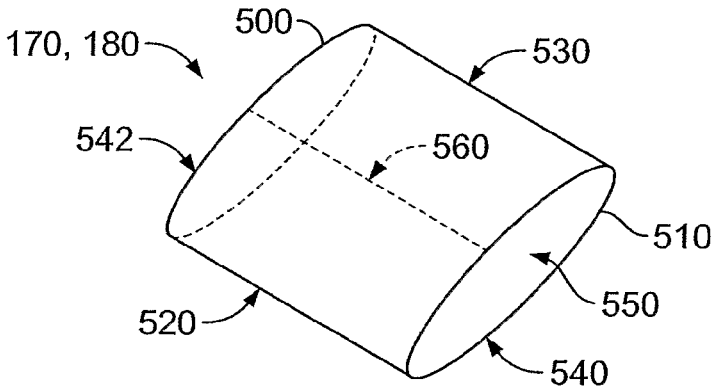
FIG. 13 is a perspective view of one embodiment of a suspension element of the present invention.

The suspension element 170,180 can have various side cross-sectional shapes, such as an elliptical shape and an oval shape. As shown in FIG. 12, the side cross sectional shape is an end-pointed shape in that the first and second arms 500,510 form a point at the first and second ends 520,530. As shown in many of the figures, the ends 520,530 can also be rounded. Combinations of various shapes are also possible.

Figure 14:
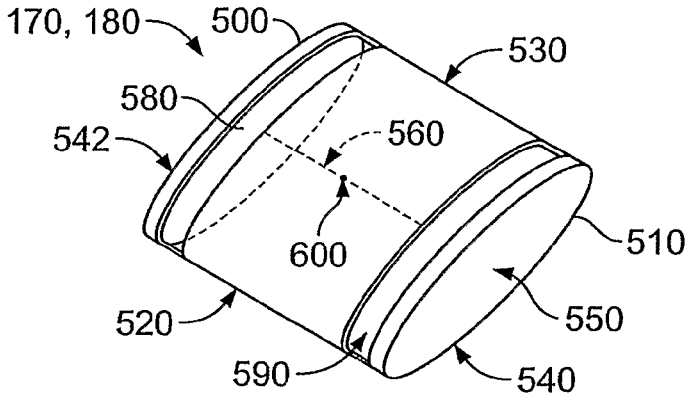
FIG. 14 is a perspective view of one embodiment of a suspension element of the present invention.
Figure 21:
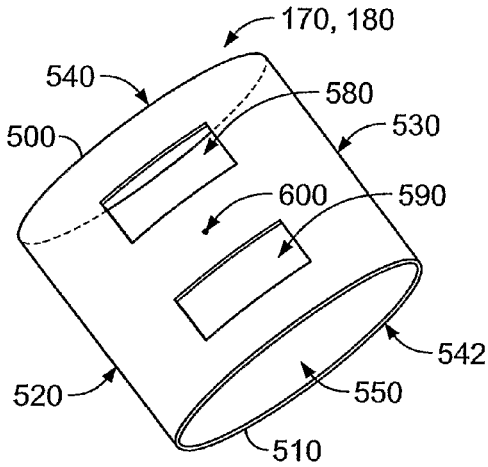
FIG. 21 is a perspective view of one embodiment of a suspension element of the present invention.

Referring to FIGS. 14, 21, 29, and 30, additional embodiments of the suspension element 170,180 are shown, each having a first aperture 580 and a second aperture 590. In the embodiment of FIG. 14, the first and second apertures 580, 590 are located adjacent to the first and second lateral sides 540,542, respectively, within the upper arm 500. These apertures 580,590 extend from the first end 520 to the second end 530 of the upper suspension arm 500. In the embodiment of FIG. 21, the first and second apertures 580,590 are located more toward a midpoint between the first and second lateral sides 540,542, but with enough separation between the apertures 580,590 to provide sufficient support and spring to accommodate the needs of the designer and user for improved loading efficiency. These apertures 580,590 extend from a location which is spaced inward from the first end 520 and the second end 530 of the upper suspension arm 500. While the first and second apertures 580,590 within FIGS. 14 and 21 have a generally rectangular shape, other shapes can be used which provide for tuning of the necessary compression resistance and loading characteristics at a central point 600 of the suspension element 170,180. Providing the apertures 580, 590 in the upper arm 500 instead of narrowing the width of the overall suspension element at least provides for improved stability of the shoe 100 toward the lateral sides of the shoe.

Figure 29:
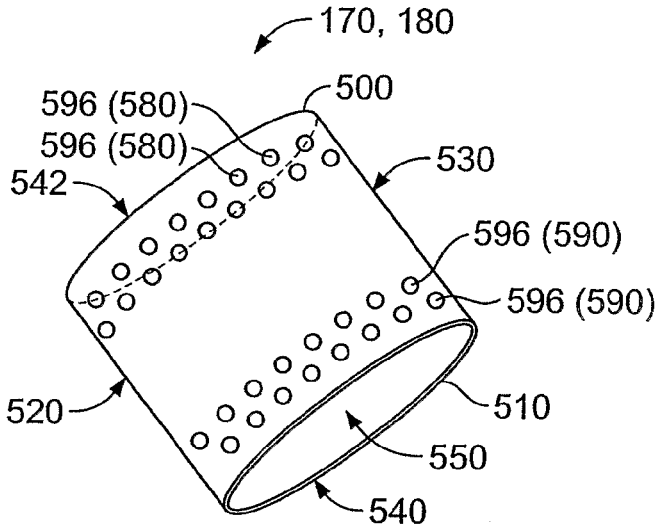
FIG. 29 is a perspective view of one embodiment of a suspension element of the present invention.
Figure 30:
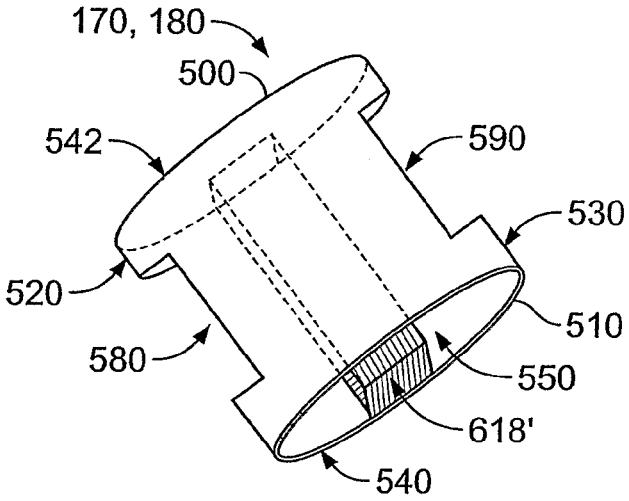
FIG. 30 is a perspective view of one embodiment of a suspension element of the present invention.

The embodiment of FIG. 29 shows that the first and second apertures 580,590 can each be made of a plurality of perforations 596, having a similar effect to the apertures shown in the other FIGS. The embodiment of FIG. 30 shows the apertures 580,590 located at the first and second ends 520,530, respectively. These apertures 580,590 can be placed and sized symmetrically in relation one another, be larger (width and/or length) in relation to one another, and/or be offset from one another. FIG. 30 is further described below in the context of FIG. 31.

Figure 15:
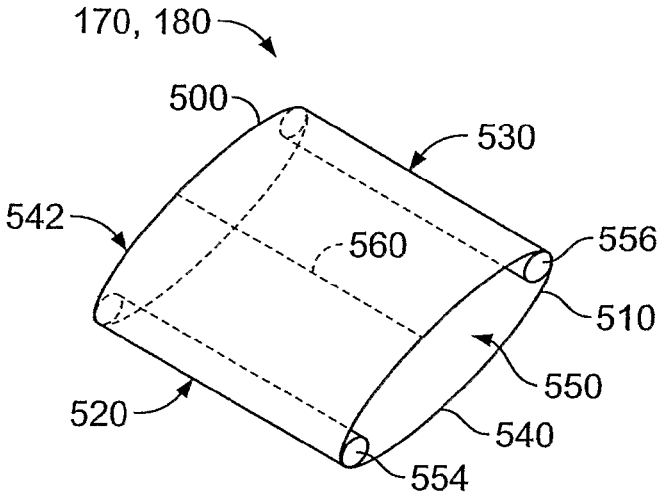
FIG. 15 is a perspective view of one embodiment of a suspension element of the present invention.
Figure 28:
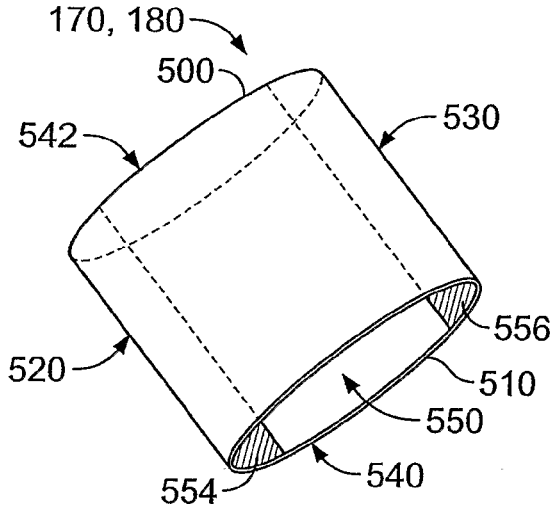
FIG. 28 is a perspective view of one embodiment of a suspension element of the present invention.

Referring to FIGS. 15 and 28, an additional embodiment of the suspension element 170,180 is shown. The central suspension region 550 of this embodiment has a first reinforcement member 554 and a second reinforcement member 556 positioned toward the respective first and second ends 520, 530. These reinforcement members 554,556 are adhered to the interior surface of the suspension element 170,180 with an adhesive or other method of integrating the reinforcement members with the suspension element 170,180. The reinforcement members 554,556 can provide for added structural integrity and potentially extended longevity of the suspension element 170,180. The reinforcement members 554,556 can have a cylindrical shape or some other shape, such as for example an elongated shape with a semi-circle or semi-oval cross section (not shown). The reinforcement members 554, 556 can be of wood, metal, plastic, and/or some other ridged or semi-ridged light-weight material. Alternatively, the reinforcement members can be a foam, such as a low-density foam, located in the same or similar place as the members, but not necessarily in the shape of a cylinder. FIG. 28 shows first and second foam elements 554,556 respectively, located in a similar place as the members 554,556 of FIG. 15.

Figure 16:
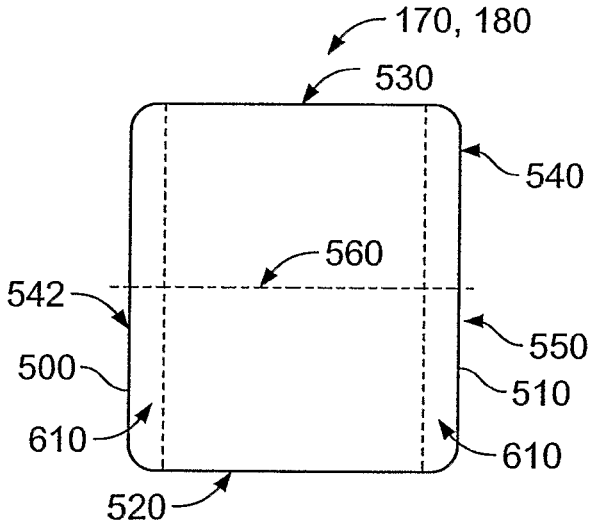
FIG. 16 is top view of one embodiment of a suspension element of the present invention.
Figure 17:
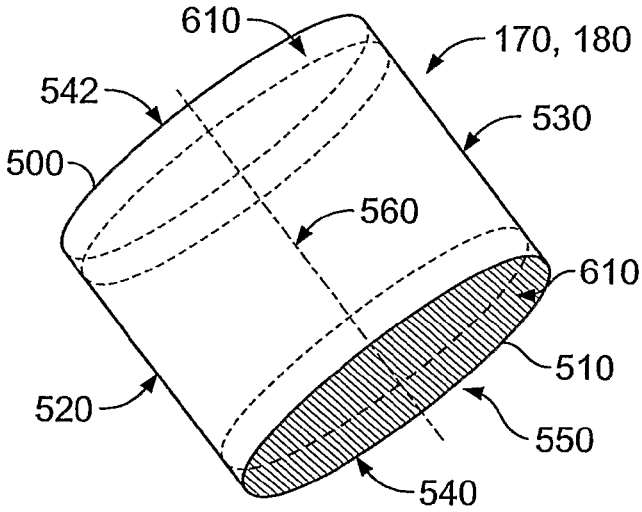
FIG. 17 is a perspective view of one embodiment of a suspension element of the present invention.
Figure 34:
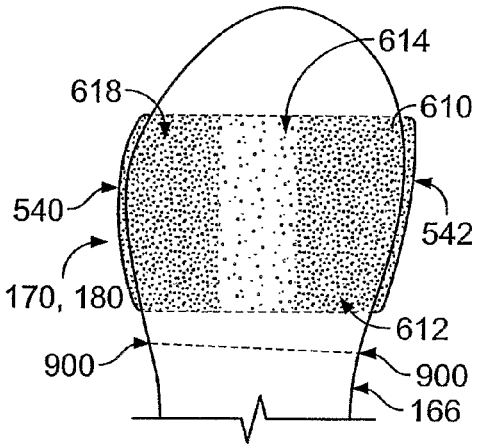
FIG. 34 is a partial top view of a shoe of the present invention with one embodiment of a front suspension element with a material such as foam having varying density regions, within the front suspension element.
Figure 35:
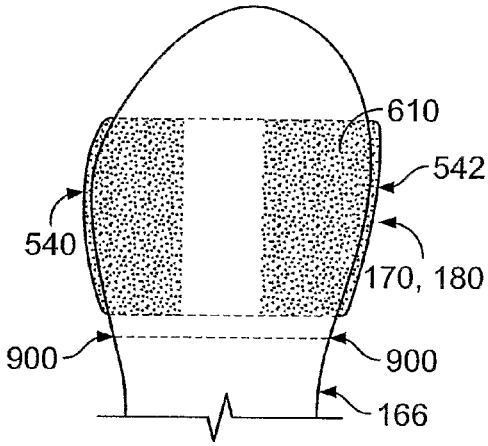
FIG. 35 is a partial top view of a shoe of the present invention with one embodiment of a front suspension element with a material such as foam in certain regions within the front suspension element.

Referring to FIGS. 16, 17, 34, and 35, additional embodiments of the suspension element 170,180 are shown. The central suspension region 550 of each of these embodiments is at least partially filled with low-density foam 610 or other similar material which does not affect the performance characteristics of the suspension element 170,180. However, materials such as a higher density foam may be used to assist in altering and enhancing the performance characteristics of the suspension element 170,180. In at least the embodiments of FIGS. 16 and 17, the foam 610 closes the first and second sides 540, 542 for preventing debris from entering the first and second sides 540,542. The central suspension region 550 of the suspension element 170,180 can be considered to have various regions. For example, as shown in FIGS. 16, 17, and 35, foam 610 toward the first lateral side 540 is located in a first region within the central suspension region 550, foam 610 toward the second lateral side 542 is located in a second region within the central suspension region 550, and a third region is located between the first and second regions and which does not contain any foam. Foam densities of differing values can be selected for the different regions to provide for no effect on the performance of the suspension element 170, 180 in one region and for improved load capacity or stability in another region. For example, a designer may wish to increase the density of the foam 610 in a region located toward the anterior of a user's foot to improve stability of the use of the shoe on the anterior side of the user, but the foam 610 located in other regions, such as toward the interior of the user's foot, can have a lower (or different) density to provide for other functions such as preventing debris from entering the central suspension region 550 without affecting the performance of the suspension element 170,180 within such other sub-regions of the central suspension region 550. This is generally shown in the embodiment of FIG. 34 as well, except that the foam 610 is located throughout the central suspension region. Specifically, foam 612 located in a first region can have a first density which provides for some improved stability in combination with the characteristics of the suspension element 170,180 and which prevents debris from entering the central suspension region 550. Foam 614 located in a second region can have a second density which provides for some improved stability in combination with the characteristics of the suspension element 170,180, but less than the foam 612. Foam 618 located in a third region can have a third density which provides for significant improved stability in combination with the characteristics of the suspension element 170, 180 and which prevents debris from entering the central suspension region 550, as this third region would be located toward the exterior of the user's foot.

Figure 31:
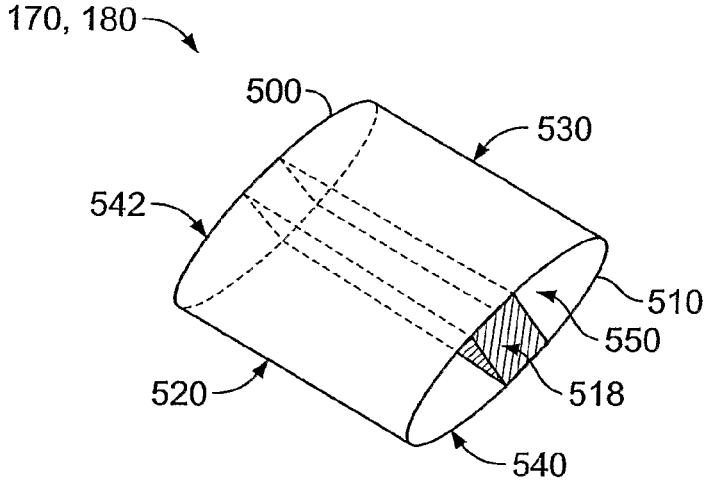
FIG. 31 is a perspective view of one embodiment of a suspension element of the present invention.

Referring to FIG. 31, an additional embodiment of the suspension element 170,180 is shown, which also uses foam. The central suspension region 550 of this embodiment is at least partially filled with low-density foam 618 or other similar material which does not affect the performance characteristics of the suspension element 170,180. However, materials such as a higher density foam 618 may be used to assist in altering and enhancing the performance characteristics of the suspension element 170,180. The foam element 618 of this embodiment extends from the first lateral side 540 to the second lateral side 542 along the center of compression (not shown—see other FIGS). This embodiment can be altered slightly by reducing the height of the foam element 618 to form a foam or bumper element 618', shown in FIG. 30. Specifically, bumper element 618' can be a higher density foam or other material with appropriate characteristics which can act as a bumper or over compression support or stop. The bumper 618' can extend from the first lateral side 540 to the second lateral side 542. The bumper 618' can also take the form of more than one piece, such as the embodiment of FIG. 32, described below. The bumper 618' can also extend less than the full width of the suspension element 170,180. Further, the bumper 618' can be in an end 520 to end 530 orientation (not shown).

Figure 32:
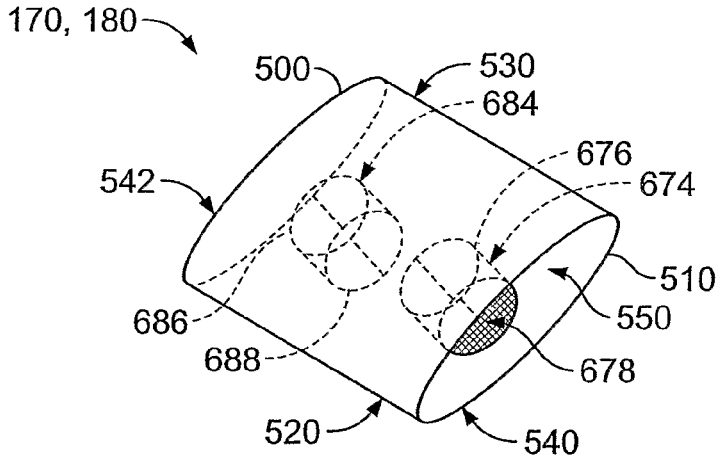
FIG. 32 is a perspective view of one embodiment of a suspension element of the present invention.

Referring to FIG. 32, an additional embodiment of the suspension element 170,180 is shown, which also uses foam. The central suspension region 550 of this embodiment is at least partially filled with low-density foam 674,684 or other similar material which does not affect the performance characteristics of the suspension element 170,180. However, materials such as a higher density foam 674,684 may be used to assist in altering and enhancing the performance characteristics of the suspension element 170,180. The first and second columns of foam 674,684 can be used at or near the sides 540,542 (shown) or the ends 520,530 (not shown) of the suspension element to allow motion control or load capacity improvement. The columns can be attached at the lower surface 678,688, and the upper surface 676,686 of the interior suspension region 550 of the suspension element 170,180, to at least maximize suspension element resiliency upon extension from a deflected position. The columns could be removable and changeable to tailor performance characteristics. Highly resilient urethane foam is preferred. Columns may be simple cylinders or more complex hollow or accordion pleated shapes to vary compression characteristics and therefore suspension element ride qualities.

Figure 18:
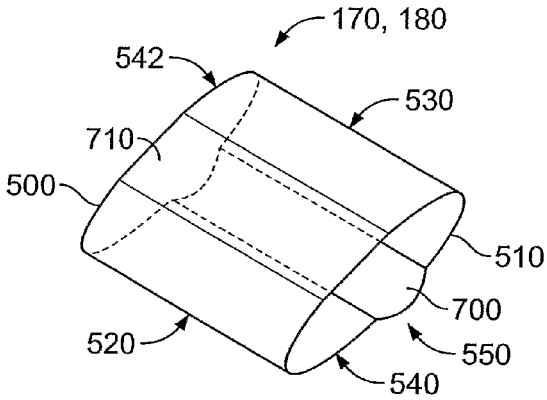
FIG. 18 is a perspective view of one embodiment of a suspension element of the present invention.
Figure 19:
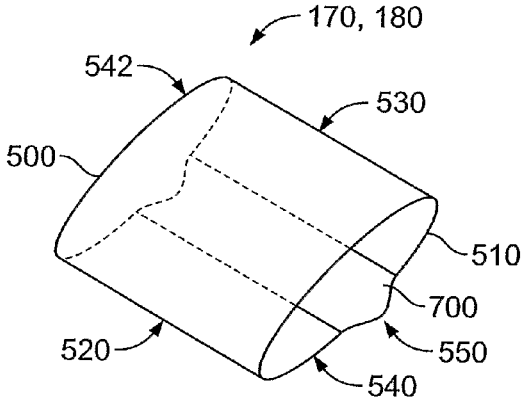
FIG. 19 is a perspective view of one embodiment of a suspension element of the present invention.

Referring to FIGS. 18, 19, and 23, additional embodiments of the suspension element 170,180 are shown. The lower arm 510 of each of these suspension elements 170,180 has a protrusion 700 with a generally concave shape from a top view. The downward protrusion 700 of the embodiments FIGS. 18 and 19 extends the lateral width of the suspension element 170,180, while the protrusions 700 of the embodiment of FIG. 23 begin at each of the lateral first and second sides 540,542 and move toward the midpoint between the lateral sides 540,542, converging with the bottom surface of the lower arm 510 in a conical section shape. The suspension element of FIG. 18 further has a flat upper region 710, as also shown in FIG. 5 as element 280.

Figure 22:
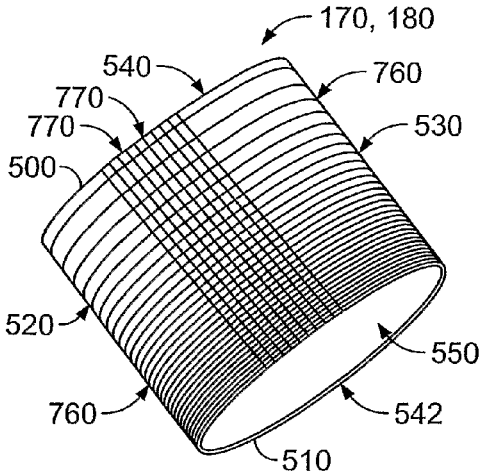
FIG. 22 is a perspective view of one embodiment of a suspension element of the present invention.
Figure 24:
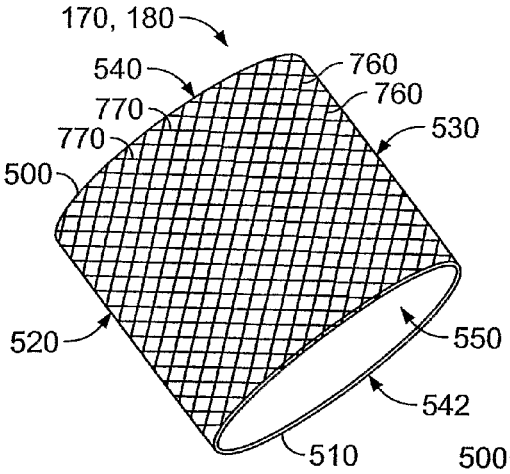
FIG. 24 is a perspective view of one embodiment of a suspension element of the present invention.
Figure 25:
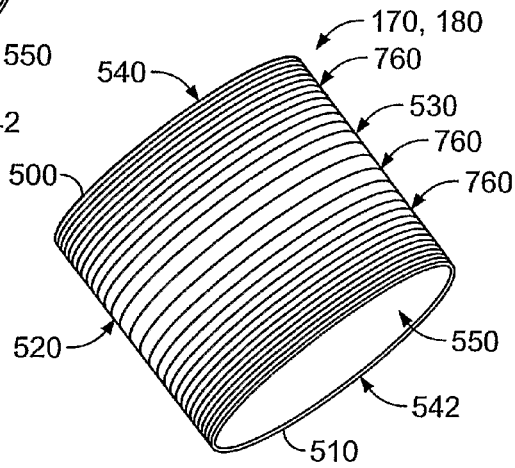
FIG. 25 is a perspective view of one embodiment of a suspension element of the present invention.
Figure 26:
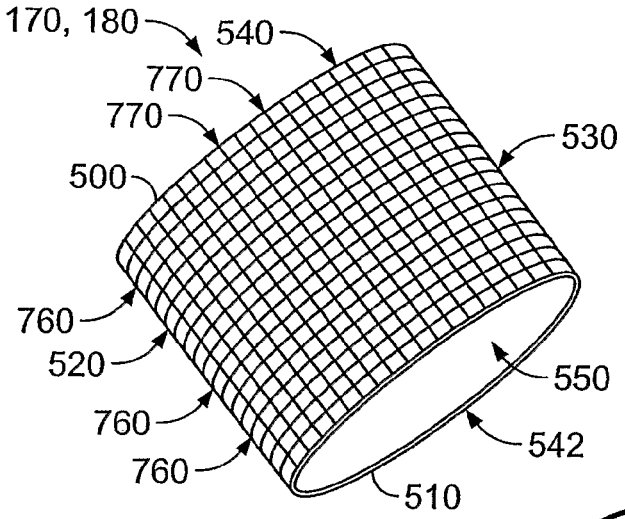
FIG. 26 is a perspective view of one embodiment of a suspension element of the present invention.

Referring to FIGS. 20, 22, 24, 25, and 26, additional embodiments of the suspension element 170,180 are shown. The suspension element 170,180 (and suspension components) can be a shaped metal material or composite, engineering polymer or composite material molded from fibers such as graphite, glass, carbon, and/or ceramic fibers or resin. These fibers or resin can be manipulated to create various fiber orientations, densities, and/or thickness to alter the suspension element 170,180 characteristics. Referring to FIGS. 20, 22, 25, and 26, each of these suspension elements 170,180 have a plurality of first fibers which generally travel in a direction from the first end 520 to the second end 530, generally oriented parallel to the lateral first and second sides 540,542. In the embodiments of FIGS. 22 and 26, each of these suspension elements 170,180 have a plurality of second fibers 770 which generally travel in a direction perpendicular to the plurality of first fibers 760, and which are generally oriented perpendicular to the lateral first and second sides 540,542. The first and second fibers 760,770 can alternatively be disposed at an angle from one another which is other than perpendicular (or other than 90 degrees).

Figure 20:
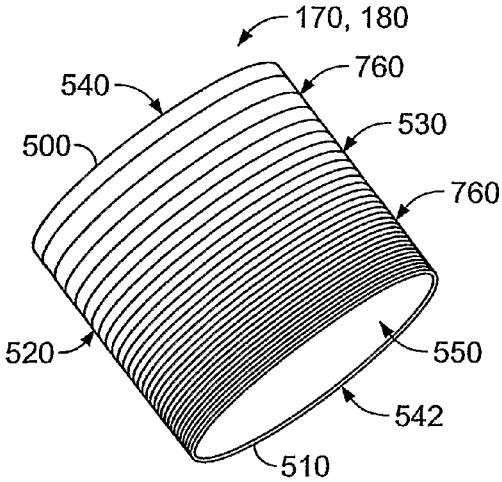
FIG. 20 is a perspective view of one embodiment of a suspension element of the present invention.

Referring to FIGS. 20, 22, and 25, the first fibers 760 are disposed in a manner to create varying densities of such fibers. In particular, in the embodiments of FIGS. 20 and 22, the density of the first fibers 760 is greater toward the second lateral side 542 in relation to the density of the first fibers 760 toward the first lateral side 540, as shown by more lines and fewer lines, respectively in these figures. In the embodiment of FIG. 25, the fiber density of the first fibers 760 is higher adjacent to the first and second sides 540,543 in relation to the fiber density at the midpoint between the first and second sides 540,542 of the suspension element 170,180

Figure 27:
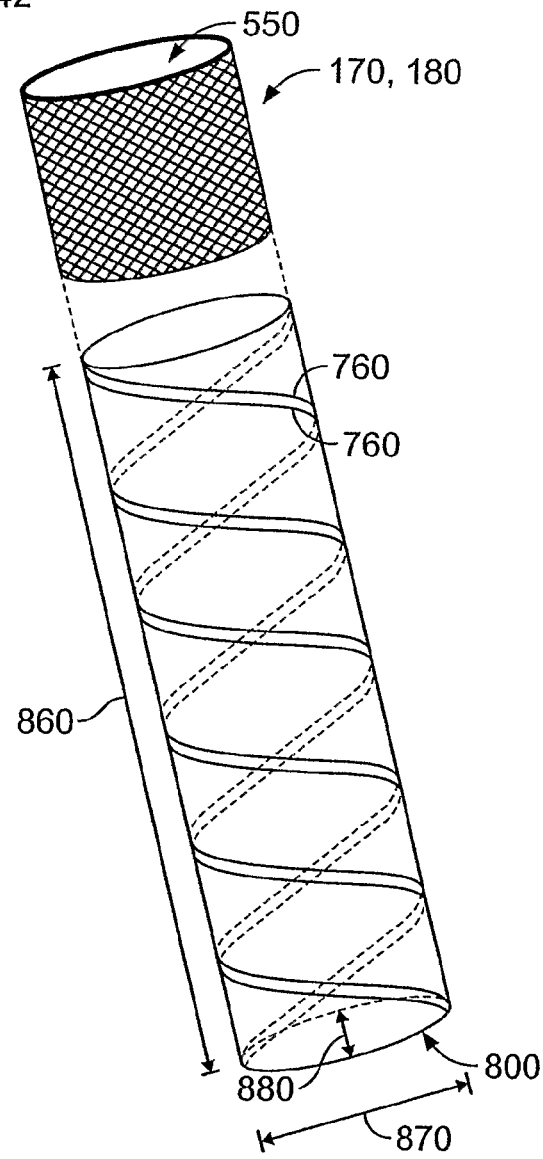
FIG. 27 is a perspective view of one embodiment of a manufacturing form which can be used in the manufacture of one or more embodiments of a suspension element, with one such finished suspension element shown separated from the form.

Referring to the embodiment of the suspension element 170,180 of FIGS. 24 and 27, the first and second fibers 760, 770 can each be oriented in manner which is not generally parallel to the lateral sides 540,542, but which are at an angle from one another, such as for example a ninety (90) degree angle from one another. FIG. 27 shows one method of making an embodiment of the suspension element 170,180 of FIG. 24. Specifically, FIG. 27 shows one method of manufacturing a suspension element 170,180 for a shoe 100. The method can include using or providing a die or form 800 having a length 860, a width 870 and a thickness 880. The length 860 accommodates a plurality of suspension elements 170,180. A plurality of fibers are wrapped around the width 870 of the die to form the suspension elements 170,180. In the embodiment of FIG. 27, the fibers are wrapped at an angle from the sides of the die (and sides of the suspension elements). The fibers are allowed to dry, or are affirmatively dried in a drying step. The unitary piece having a plurality of suspension elements 170, 180 can then removed from the die for separating into the individual suspension elements 170,180, or can be separated while still located on the die. Alternatively, the fibers can be wrapped in an orientation which is parallel to the width 870 of the die 800. The shape of the die will typically determine the shape of the suspension elements, including all of the suspension element embodiments shown and described herein. Thus, for example the die 800 can have an elliptical shape from a cross sectional view of the width 870 and thickness 880. As an additional example to create the embodiment of the suspension element 170,180 of FIG. 18, the upper surface of the die 800 can have a flat portion and a convex portion from a cross sectional view of the width 870 and thickness 880. As will be explained further below, the suspension elements 170,180 can have shaped contours for the first and/or second sides 540,542. Other materials such as titanium can be used and substituted for the fibers, in varying thicknesses and densities to achieve the same goals of the fiber variations for the suspension elements 170,180 described above, but which may require a different method of manufacture.

Figure 33:
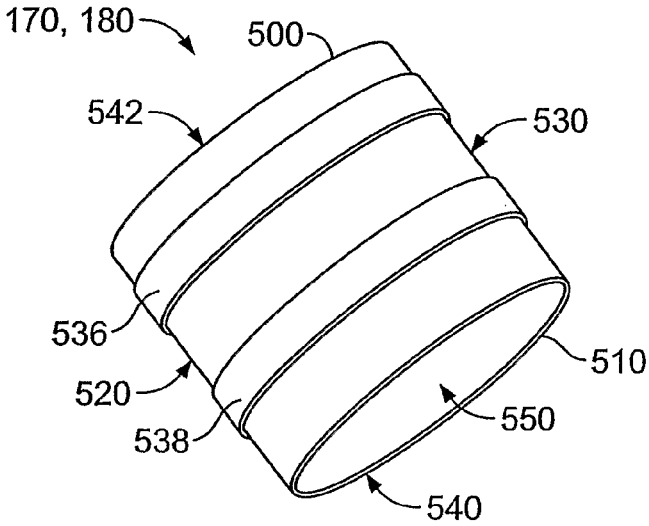
FIG. 33 is a perspective view of one embodiment of a suspension element of the present invention.

Referring to FIG. 33, an additional embodiment of the suspension element 170,180 is shown. The suspension element 170,180 includes first and second ridges 536,538 attached to the outer surface of the suspension element 170, 180. The ridges 536,538 in this embodiment each run from the first end 520 to the second end 530, but can run completely around the suspension element, more than half the circumference of the suspension element, or less than half the circumference of the suspension element (or combinations of these for each respective ridge). The ridges 536,538 can be symmetrically placed or placed asymmetrically in relation to one another (not shown). The ridges can also be narrower or wider than shown. Further, the ridges 536,538 could be placed along a path running from the first side 540 to the second side 542 or along a path which is similar to the fiber path of the suspension element of FIG. 24. The ridges 536, 538 can be made of metal or some other ridged or semi-ridged material.

Figure 36:
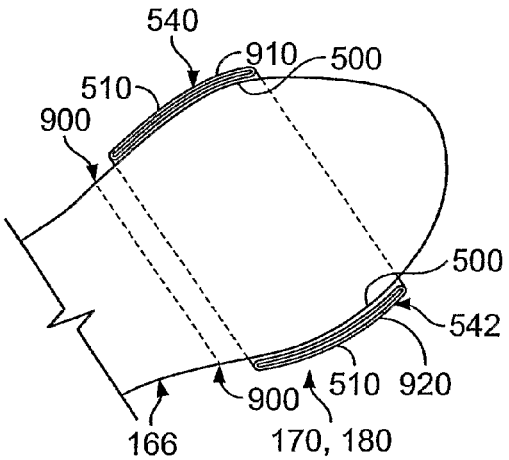
FIG. 36 is a partial top view of a shoe of the present invention with one embodiment of a front suspension element having one embodiment of contours and/or shape of sides of the front suspension element.
Figure 37:
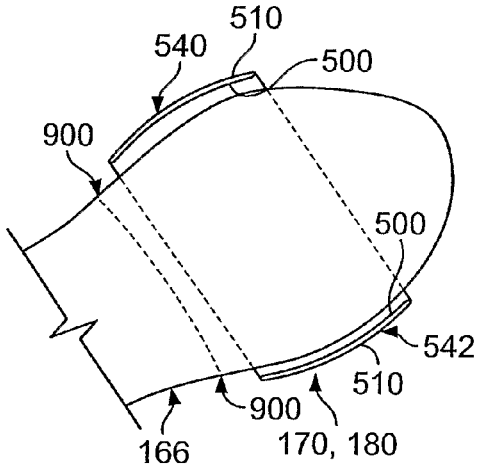
FIG. 37 is a partial top view of a shoe of the present invention with one embodiment of a front suspension element having one embodiment of contours and/or shape of sides of the front suspension element.
Figure 38:
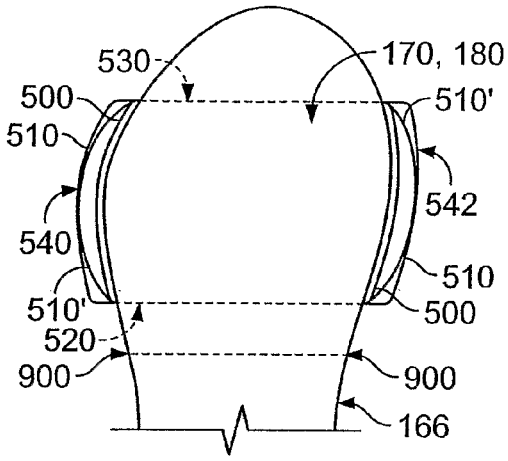
FIG. 38 is a partial top view of a shoe of the present invention with one embodiment of a front suspension element having one embodiment of contours and/or shape of sides of the front suspension element.
Figure 39:
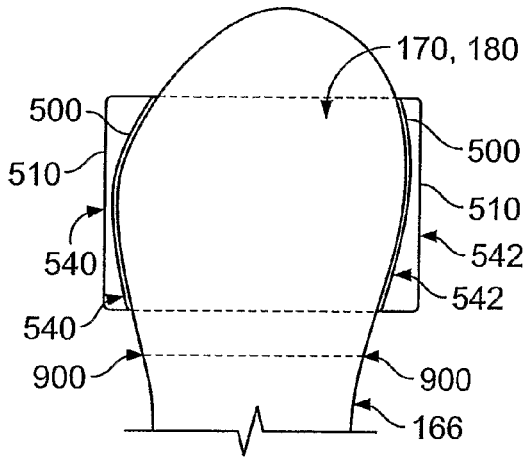
FIG. 39 is a partial top view of a shoe of the present invention with one embodiment of a front suspension element having one embodiment of contours and/or shape of sides of the front suspension element.
Figure 40:
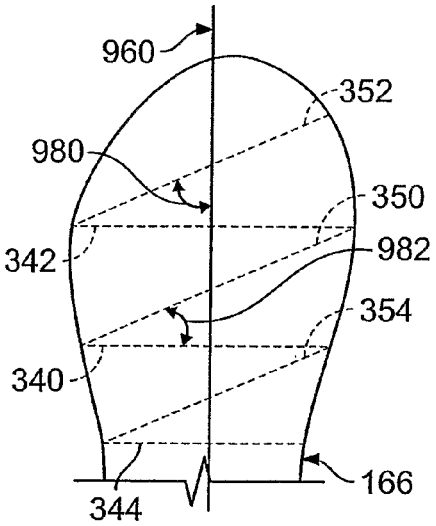
FIG. 40 is a partial top view of a shoe of the present invention with two embodiments of a front suspension element, each in a different orientation within the front of the midsole.
Figure 41:
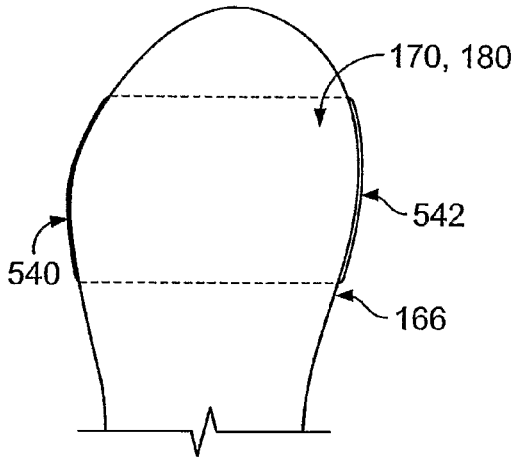
FIG. 41 is a partial top view of a shoe of the present invention with one embodiment of a front suspension element having one embodiment of contours and/or shape of sides of the front suspension element.

Referring to FIGS. 34-41, additional embodiments of the suspension element 170,180 are shown. In particular, the lateral first and second sides 540,542 of the suspension element 170,180 can have shaped contours to achieve various purposes, such as for example to reduce the size of the suspension element 170,180 for keeping the weight of the shoe at a minimum while also providing for an aesthetically pleasing side and/or perspective view of the shoe. As shown in FIG. 41, and generally in other figures, one or both of the lateral sides 540,542 of the suspension element can follow at least a portion of the side contour of the midsole 166. In addition, as shown in FIGS. 34-39, the first and second lateral sides 540, 542 of the suspension element 170,180 can extend beyond the lateral width 900 of the midsole 166 of the shoe 100. Alternatively or additionally, as shown in FIGS. 36, 37, and 38, the first lateral side 540 of the lower arm 510 can extend beyond the lateral width 900 of the midsole 166, and beyond the first lateral side 540 of the upper arm 500 of the suspension element. FIG. 38 shows alternative embodiments, one depicting the lower arm 510 generally following parallel to the upper arm 500 of the suspension element 170,180, and the other showing the lower arm 510' meeting the upper arm 500 at the ends 520, 530.

FIG. 36 further shows an embodiment of the suspension element 170,180 which has moldings 910,920 proximate the first and second lateral sides 540,542. The moldings 910,920 are formed from an added layer of composite or other material for adding strength and durability to the first and second lateral sides 540,542 of the suspension element 170,180. FIG. 38 further shows an embodiment of the suspension element 170,180 which has moldings 910,920 proximate the first and second lateral sides 540,542.

Figure 42:
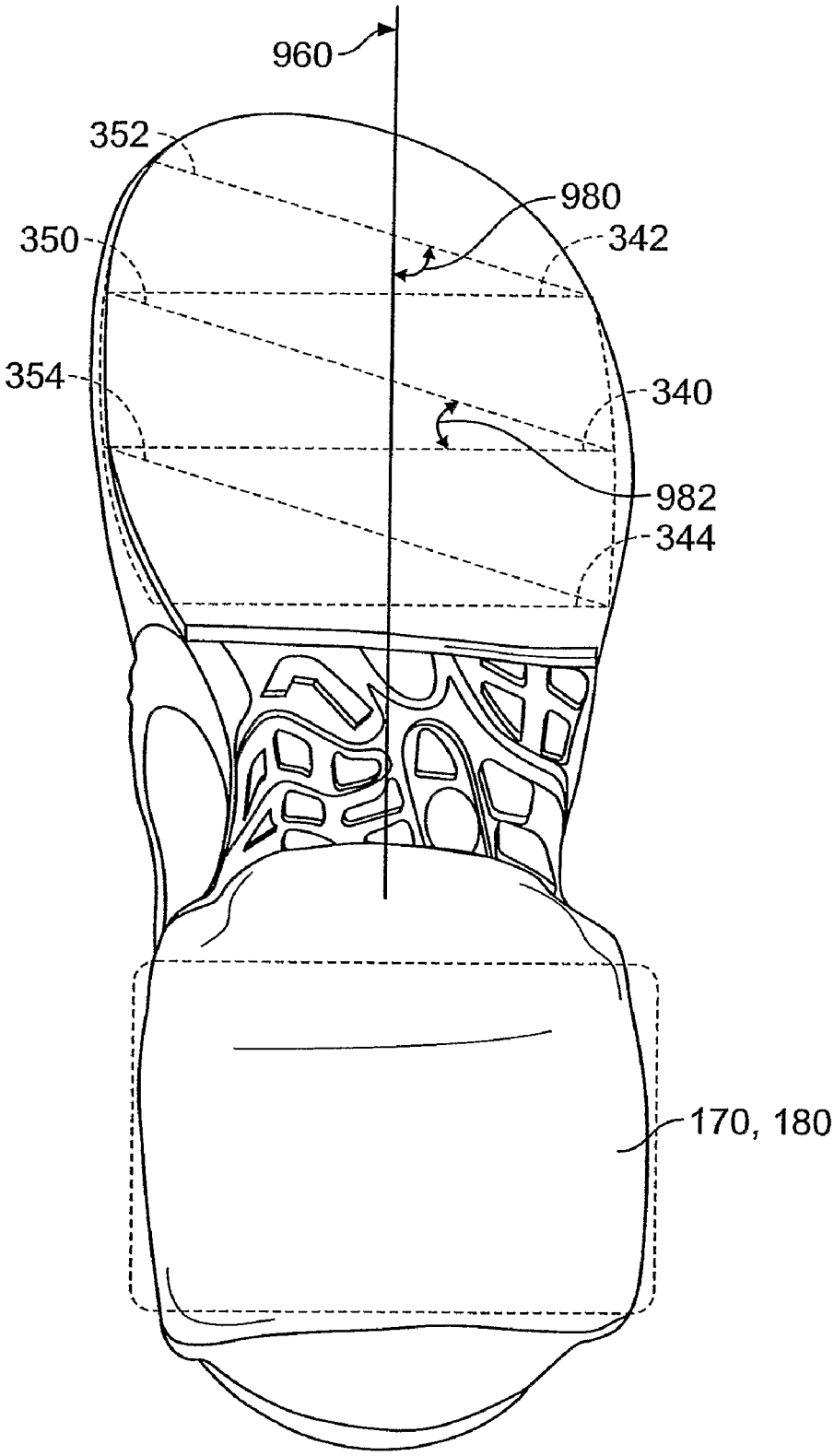
FIG. 42 is a bottom view of one embodiment of a shoe of the present invention, indicating various embodiments of the orientation of front and rear suspension elements.

Referring to FIGS. 40 and 42, as discussed above, in one embodiment, the suspension element 170,180 traverses the width 340 of the front region 140 of the shoe 100, and the traverse of the suspension element 170,180 is shown by the first end 342 and the second end 344 traversing the width of the shoe 100. In this embodiment, the center of compression 340 of the suspension element 170,180 is perpendicular to a line 960 which travels the length of the shoe 100. In another embodiment, the suspension element 170,180 traverses the front region 140 of the shoe 100, and the traverse of the suspension element 170 is alternatively shown by the first end 352 and the second end 354 traversing the width of the shoe 100, but at an angle 982 to the width 340 of the front region 140 of the shoe 100. In this embodiment, the center of compression 350 of the suspension element 170 is at an angle 980 (shown with end 352) other than perpendicular to a line 960 which travels the length of the shoe 100. In this alternative embodiment, the center of compression 350 follows the natural bend of the foot of the user for improved reduction in fatigue and improved efficiency of the shoe 100.

Figure 43:
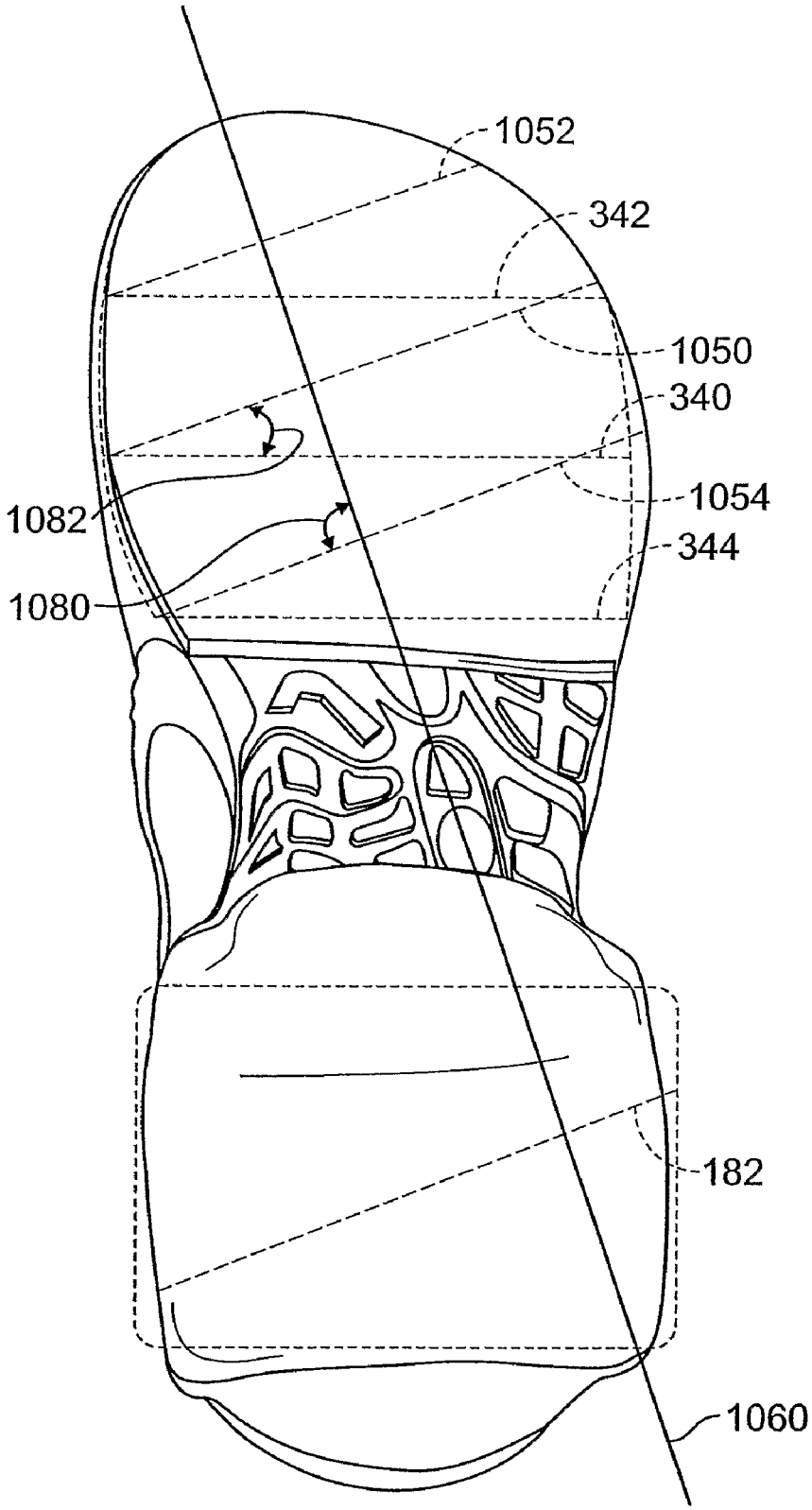
FIG. 43 is a bottom view of one embodiment of a shoe of the present invention, indicating various alternative embodiments of the orientation of front and rear suspension elements.

Referring to FIG. 43, in one embodiment, the suspension element 170,180 traverses the width 340 of the front region 140 of the shoe 100, and the traverse of the suspension element 170,180 is shown by the first end 342 and the second end 344 traversing the width of the shoe 100. A center of travel or stride 1060 is shown which is a line running from the location of the ball of the user's foot to the location of the outer heel of the user. In this embodiment, the center of compression 340 and the end 344 of the suspension element 170,180 is at an angle 1080 to the center of stride 1060 which travels the length of the shoe 100. In another embodiment, the suspension element 170,180 traverses the front region 140 of the shoe 100, and the traverse of the suspension element 170 is alternatively shown by the first end 1052 and the second end 1054 traversing the width of the shoe 100 (with a center of compression 1050). In this embodiment, the center of compression 1050 of the suspension element 170 is at an angle 1082, which is perpendicular to center of stride 1060 which travels the length of the shoe 100. Contrary to the embodiment shown in FIG. 42, in this alternative embodiment, the center of compression 1050 follows a path which compresses along a line 1050 which is perpendicular to the center of stride 1060, and not necessarily with the natural bend of the foot of the user, for improved reduction in fatigue and improved efficiency of the shoe 100 along the stride path. It should be noted that the hinge 190 (and corresponding openable gap 194) can alternatively be located along or near a path which follows the center of compression 1050 for this embodiment. Likewise the center of compression 182 for the rear suspension element 180 can follow this line to be substantially perpendicular to the center of stride 1060.

Figure 44:
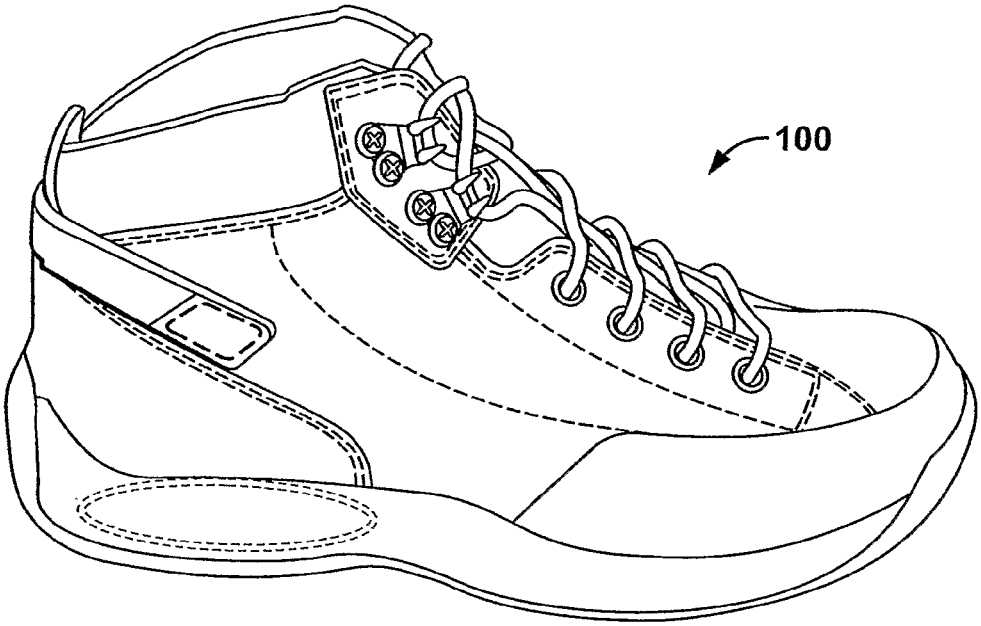
FIG. 44 is a perspective view of one embodiment of a multipurpose shoe of the present invention.
Figure 45:
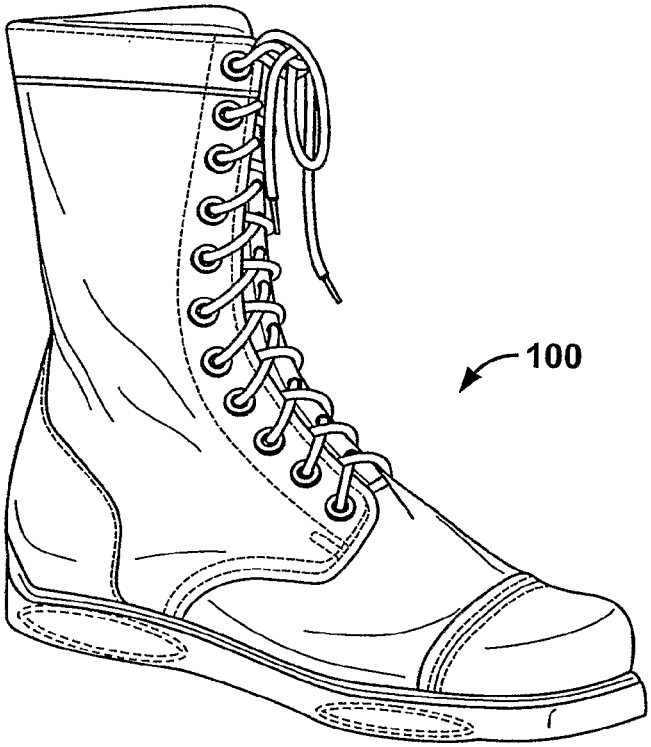
FIG. 45 is a perspective view of one embodiment of a shoe or boot of the present invention; and, FIG. 46 is a side view of one embodiment of the midsole of at least FIG. 2.

Referring to FIGS. 44 and 45, additional embodiments of a shoe 100 of the present invention are shown. FIG. 44 shows hiking shoe and/or cross training shoe embodiments, which can encompass some or all of the concepts of the invention therein. FIG. 45 shows a boot embodiment, which can also encompass some or all of the concepts of the invention therein. It should be understood that the outsole 168 and the midsole 166 can be formed as a single unitary structure for some or all of the embodiments herein and other embodiments of the present invention.

Material for the suspension element 170,180 may be obtained from various manufacturers and sources. For example, the material may be obtained from Performance Materials Corporation, located at 1150 Calle Suerte, Camarillo, Calif. 93012. Information may be obtained on this company's materials at www.performancematerials.com, the content of which is incorporated herein by reference. This material can be a thermoplastic composite material which has patterns and colors which are aesthetically pleasing to the user and potential purchaser, while also being functional in nature. These patterns or combinations of patterns can be used at least within the interior surface of the suspension element 170,180 or central suspension region 550, especially when viewable from the side of the shoe (no foam to prevent debris from entering the central suspension region 550). These patterns or combinations thereof can also be used for any portion of the suspension element 170,180 which is visible to a user, such as the portion of the lateral sides 540,542 of the suspension element 170,180 which are flush with the sides of the midsole 166 or which extend beyond the lateral width of at least a portion of the lateral width of the midsole 166 of the shoe 100.

In each of the embodiments described herein, the upper 110 can have a generally horizontal bottom wall 120. The bottom wall 120 can have an upper surface 130 and a lower surface 132. The upper 110 can comprises a forward region 140 having a forward center of loading 142 and a rear region 150 having a rear center of loading 152. The upper surface 120 can have a front receiving area (not shown) and a rear receiving area (not shown), each which is lower than the other areas of the upper surface 120, and each for receiving the ball of the foot and the heel of the foot more naturally, similar to the receiving areas of prior shoes, such as BIRKENSTOCK shoes.

It will be understood that the invention may be embodied in other specific forms without departing from the spirit or central characteristics thereof. The present embodiments, therefore, are to be considered in all respects as illustrative and not restrictive, and the invention is not to be limited to the details given herein.

What is claimed is:

1. A shoe comprising:

an upper having a generally horizontal bottom wall, the bottom wall having an upper surface and a lower surface, wherein the upper comprises a forward region having a forward center of loading and a rear region having a rear center of loading; and, a sole comprising a midsole and an outsole, the outsole having a rear lateral center position below the rear center of loading and a forward lateral center position below the forward center of loading, wherein the outsole follows a rocker curve from the rear lateral center position substantially toward a heel position of the outsole and from the forward lateral center position substantially toward a front end position of the outsole, the midsole comprising a first composite suspension element and a second composite suspension element, each of the first and second composite suspension elements constructed of a material having a substantially lower hysteresis than adjacent midsole materials and having a generally elliptical shape defined by a generally convex upper suspension arm and a generally concave lower suspension arm, each of the first and second composite suspension elements having a center of compression, wherein the center of compression of the first composite suspension element is generally aligned with the forward center of loading of the upper and wherein the center of compression of the second composite suspension element is generally aligned with the rear center of loading of the upper, the generally concave lower suspension arm of the first composite suspension element having a first radius of curvature generating a first curve and the generally concave lower suspension arm of the second composite suspension element having a second radius of curvature generating a second curve, wherein the first curve is generally parallel to the rocker curve of the outsole from the forward lateral center position substantially toward a front end position of the outsole, and wherein the second curve is generally parallel to the rocker curve of the outsole from the rear lateral center position substantially toward a heel position of the outsole.

2. The shoe of claim 1 wherein the first radius of curvature is distinct from and greater than the second radius of curvature.

3. The shoe of claim 1 wherein a first plane generally bisects the upper and lower arms of the first composite suspension element, wherein a second plane generally bisects the upper and lower arms of the second composite suspension element, wherein the first plane is positioned at a first predetermined angle in relation to a generally horizontal plane of the midsole, and wherein the second plane is positioned at a second predetermined angle in relation to the generally horizontal plane of the midsole.

4. The shoe of claim 3 wherein the first and second predetermined angles extend in the opposite direction in relation to the generally horizontal plane of the midsole.

5. The shoe of claim 4 wherein the first and second predetermined angles are the same.

6. The shoe of claim 1 wherein at least one of the first and second composite suspension elements extend substantially across a width of the midsole proximate the respective at least one of the first and second composite suspension elements.

7. The shoe of claim 1 wherein the midsole and outsole together comprise a plurality of layers and materials proximate first and second composite suspension elements, and wherein the plurality of layers and materials are constructed proximate the first and second composite suspension elements to provide a zero to low change in the rate of loading throughout a user stride.

8. The shoe of claim 1 wherein the outsole is connected to a lower exterior surface of each of the first and second composite suspension elements of the midsole at least proximate the center of compression of each of the first and second composite suspension elements for reducing the change in the rate of loading.

9. The shoe of claim 1 wherein the lower surface of the bottom wall of the upper is connected to the upper suspension arm of each of the first and second composite suspension elements for reducing the change in the rate of loading.

10. The shoe of claim 1, wherein the upper suspension arm of each of the first and second composite suspension elements has a first end and a second end, and the lower suspension arm of each of the first and second composite suspension elements has a first end and a second end, each of the first and second ends of the respective upper and lower suspension arms being joined together to form the composite suspension element, and forming open first and second sides and a hollow central suspension region therebetween.

11. The shoe of claim 10, wherein at least one of the first and second composite suspension elements is at least partially filled with foam to close the first and second sides for preventing debris from entering the first and second sides.

12. The shoe of claim 10, wherein the hollow central suspension region is at least partially filled with foam.

13. The shoe of claim 1 wherein the sole comprises an openable gap extending the lateral width of the sole, the openable gap having a horizontal component and a vertical component, and extending along a path which generally follows at least a portion of an upper surface of the composite suspension element.

14. The shoe of claim 1 wherein the midsole comprises a side contour, wherein the first and second composite suspension elements each comprise first and second lateral sides, and wherein at least one of the lateral sides follows at least a portion of the side contour of the midsole.

15. The shoe of claim 1 wherein the upper suspension arm and the lower suspension arm of each of the first and second composite suspension elements are formed as a single unitary structure.

16. The shoe of claim 1 wherein the outsole and the midsole are formed as a single unitary structure.

17. The shoe of claim 1 wherein each of the first and second composite suspension elements comprise a first suspension component and a second suspension component, each suspension component having a generally elongated shape, a first upper suspension arm having a first end and a second end, and a second lower suspension arm having a first end and a second end, each of the first and second ends of the respective first and second suspension arms of the respective first and second suspension components connected together to form the respective suspension components, and forming first and second sides and a central suspension region therebetween for each of the respective suspension components, the shoe further comprising a ridged support located between the composite suspension element and the upper for distributing loading between the first and second suspension components of each of the first and second composite suspension elements.

18. A shoe comprising:

an upper having a generally horizontal bottom wall, the bottom wall having an upper surface and a lower surface, wherein the upper comprises a forward region having a forward center of loading and a rear region having a rear center of loading;

a sole comprising a midsole and an outsole, the outsole having a rear lateral center position below the rear center of loading and a forward lateral center position below the forward center of loading, wherein the outsole follows a rocker curve from the rear lateral center position substantially toward a heel position of the outsole and from the forward lateral center position substantially toward a front end position of the outsole, the midsole comprising a first composite suspension element and a second composite suspension element, each of the first and second composite suspension elements constructed of a material having a substantially lower hysteresis than adjacent midsole materials and having a generally elliptical shape defined by a generally convex upper suspension arm and a generally concave lower suspension arm, each of the first and second composite suspension elements having a center of compression, wherein the center of compression of the first composite suspension element is generally aligned with the forward center of loading of the upper and wherein the center of compression of the second composite suspension element is generally aligned with the rear center of loading of the upper, the generally concave lower suspension arm of the first composite suspension element having a first radius of curvature generating a first curve and the generally concave lower suspension arm of the second composite suspension element having a second radius of curvature generating a second curve, wherein the first radius of curvature is distinct from and greater than the second radius of curvature.

19. The shoe of claim 18, wherein the first curve is generally parallel to the rocker curve of the outsole from the forward lateral center position substantially toward a front end position of the outsole, and wherein the second curve is generally parallel to the rocker curve of the outsole from the rear lateral center position substantially toward a heel position of the outsole.

20. A shoe comprising:

an upper having a generally horizontal bottom wall, the bottom wall having an upper surface and a lower surface, wherein the upper comprises a forward region having a forward center of loading and a rear region having a rear center of loading;

a sole comprising a midsole and an outsole, the outsole having a rear lateral center position below the rear center of loading and a forward lateral center position below the forward center of loading, wherein the outsole follows a rocker curve from the rear lateral center position substantially toward a heel position of the outsole and from the forward lateral center position substantially toward a front end position of the outsole, the midsole comprising a first composite suspension element and a second composite suspension element, each of the first and second composite suspension elements constructed of a material having a substantially lower hysteresis than adjacent midsole materials and having a generally elliptical shape defined by a generally convex upper suspension arm and a generally concave lower suspension arm, each of the first and second composite suspension elements having a center of compression, wherein the center of compression of the first composite suspension element is generally aligned with the forward center of loading of the upper and wherein the center of compression of the second composite suspension element is generally aligned with the rear center of loading of the upper, the generally concave lower suspension arm of the first composite suspension element having a first radius of curvature generating a first curve and the generally concave lower suspension arm of the second composite suspension element having a second radius of curvature generating a second curve, wherein a first plane generally bisects the first and second arms of the first composite suspension element, wherein a second plane generally bisects the first and second arms of the second composite suspension element, wherein the first plane is positioned at a first predetermined angle in relation to a generally horizontal plane of the midsole, and wherein the second plane is positioned at a second predetermined angle in relation to the generally horizontal plane of the midsole.

21. The shoe of claim 20 wherein the first and second predetermined angles extend in the opposite direction in relation to the generally horizontal plane of the midsole.

22. The shoe of claim 21 wherein the first and second predetermined angles are the same.

23. The shoe of claim 20 wherein the first curve is generally parallel to the rocker curve of the outsole from the forward lateral center position substantially toward a front end position of the outsole, and wherein the second curve is generally parallel to the rocker curve of the outsole from the rear lateral center position substantially toward a heel position of the outsole.

24. A shoe comprising:

an upper having a generally horizontal bottom wall, the bottom wall having an upper surface and a lower surface, wherein the upper includes a forward region having a forward center of loading and a rear region having a rear center of loading; and a sole including a midsole and an outsole, the outsole having a rear lateral center position below the rear center of loading and a forward lateral center position below the forward center of loading, wherein the outsole follows a rocker curve from the rear lateral center position substantially toward a heel position of the outsole and from the forward lateral center position substantially toward a front end position of the outsole, the midsole including a composite suspension element, the composite suspension element constructed of a material having a substantially lower hysteresis than adjacent midsole materials and having a generally elliptical shape defined by a generally convex upper suspension arm and a generally concave lower suspension arm, the composite suspension element having a hollow suspension region between the upper suspension arm and the lower suspension arm such that a hollow region extends through the composite suspension element from a lateral side of the midsole to a medial side of the midsole, the composite suspension element having a center of compression generally aligned with one of the forward center of loading or the rear center of loading of the upper, the generally concave lower suspension arm of the composite suspension element having a radius of curvature generating a curve, the curve being generally parallel to the rocker curve of the outsole beneath the composite suspension element.

25. The shoe of claim 24 wherein the sole comprises an openable gap extending the lateral width of the sole, the openable gap having a horizontal component and a vertical component, and extending along a path which generally follows at least a portion of an upper surface of the composite suspension element.

26. The shoe of claim 24 wherein the outsole and the midsole are formed as a single unitary structure.

27. The shoe of claim 24 wherein the composite suspension element has a center of compression generally aligned with the rear center of loading of the upper, and the shoe further comprises a second composite suspension element having a generally elliptical shape defined by a generally convex upper suspension arm and a generally concave lower suspension arm, the second composite suspension element having a hollow suspension region between the upper suspension arm and the lower suspension arm such that a second hollow region extends through the composite suspension element from the lateral side of the midsole to be medial side of the midsole, the second composite suspension element having a center of compression generally aligned with the front center of loading of the upper, the generally concave lower suspension arm of the second composite suspension element having a second radius of curvature generating a second curve, the second curve being generally parallel to the rocker curve of the outsole beneath the second composite suspension element.

28. The shoe of claim 27 wherein the radius of curvature of the composite suspension element is greater than the second radius of curvature.

29. The shoe of claim 27 wherein the midsole comprises a side contour, wherein the composite suspension element and the second composite suspension element each comprise first and second lateral sides, and wherein at least one of the lateral sides follows at least a portion of the side contour of the midsole.

30. The shoe of claim 27 wherein the upper suspension arm and the lower suspension arm of each of the composite suspension element and the second composite suspension element are formed as a single unitary structure.

* * * * *